US005443642A

United States Patent [19]

Bienduga

[11] Patent Number: 5,443,642

[45] Date of Patent: Aug. 22, 1995

[54] APPARATUS FOR ELECTROSTATIC SPRAY PAINTING

[75] Inventor: Thomas J. Bienduga, Glendale Heights, Ill.

[73] Assignee: Wagner Systems Inc., Glendale Heights, Ill.

[21] Appl. No.: 141,247

[22] Filed: Oct. 22, 1993

[51] Int. Cl.[6] ..... B05C 5/00

[52] U.S. Cl. ..... 118/688; 118/623; 118/663; 118/708; 118/712

[58] Field of Search ..... 118/688, 663, 697, 698, 118/712, 708, 621, 623, 309, 310, 326

[56] References Cited

U.S. PATENT DOCUMENTS

| | | | |
|---|---|---|---|
| 3,960,323 | 6/1976 | Duncan et al. | 239/3 |
| 4,094,654 | 6/1978 | Prinzing | 118/326 |
| 4,245,551 | 1/1981 | Berkmann | 118/326 |
| 4,402,030 | 8/1983 | Moser et al. | 118/671 |
| 4,675,203 | 6/1987 | Scarborough | 427/27 |
| 4,867,063 | 9/1989 | Baker et al. | 101/424.2 |
| 4,878,454 | 11/1989 | Cann | 118/663 |
| 5,014,645 | 5/1991 | Cann et al. | 118/663 |
| 5,029,553 | 7/1991 | Cox | 118/627 |
| 5,078,084 | 1/1992 | Shutic et al. | 118/309 |
| 5,083,814 | 1/1992 | Guinta et al. | 101/483 |
| 5,095,811 | 3/1992 | Shutic et al. | 118/326 |
| 5,107,756 | 4/1992 | Diaz | 454/53 |
| 5,167,714 | 12/1992 | Gimben et al. | 118/688 |
| 5,225,239 | 7/1993 | Ostin | 118/683 |

OTHER PUBLICATIONS

Brochure entitled "Nordson® Versa-Screen™ Work Station", Nordson Corporation, 1993.

*Primary Examiner*—W. Gary Jones
*Assistant Examiner*—Laura E. Edwards
*Attorney, Agent, or Firm*—Fitch, Even, Tabin & Flannery

[57] ABSTRACT

Apparatus for electrostatic spray painting having a painting chamber to which is connected a spray gun fed by a paint powder delivery system. A powder supply provides a high potential across the painting chamber and the spray gun to develop an electrostatic field to pull the paint powder ejected by the spray gun toward a workpiece positioned within the paint chamber. A humidity sensor is located in proximity with the paint powder delivery system for detection of an amount of moisture. A humidity signal is produced in response to the sensed humidity. A remote computer may be connected to receive a plurality of process condition signals including the humidity signal and to provide a display indicative thereof.

6 Claims, 31 Drawing Sheets

APPARATUS FOR ELECTROSTATIC SPRAY PAINTING

BACKGROUND OF THE INVENTION

The invention relates to apparatus for electrostatic spray painting. In particular, the invention relates to apparatus for electrostatic spray painting having a remote monitoring system for real time display of multi-system process conditions.

Apparatus for electrostatic spray painting employing paint powder is well known and often includes a spray booth having a painting chamber therein. A workpiece conveyor moves workpieces to be painted through the painting chamber while spray guns receive paint powder from hoppers and deliver the paint powder to the painting chamber. A high voltage power supply typically provides a potential of about 100,000 volts between the tip of the spray gun and the workpiece to which the paint powder is to be applied. The workpiece is usually grounded. The electrostatic potential applies an electrical force to the paint particles which leave the jet of the spray gun and carry them into contact with the workpiece. Such spray booth apparatus also includes a roll-away filter assembly of the type disclosed in U.S. Pat. No. 5,107,756 to Diaz which filter apparatus periodically has back pressure applied to canister filters to drive off accumulated paint particles filtered from the booth air to prevent the canister filters from clogging.

Oftentimes such apparatus operate under the control of programmable logic controllers of the type which employ ladder logic or stepwise logic. Unfortunately, such programmable controller versions of spray booth apparatus are relatively inflexible and, in addition, do not provide for the easy of or detection of process conditions.

One such process condition, the humidity of the paint powder, is influenced by the humidity of the high pressure air used to propel the paint powder from the guns. 0It may be appreciated that humidity of the paint powder must be closely monitored to avoid sticking or clogging of the paint powder in the spray gun which could lead to spray gun spitting, yielding and uneven coating on the workpiece or complete clogging of the apparatus altogether.

Other problems typically associated with said spray booth apparatus are the danger of booth fires caused by unwanted arcing between the gun tips and grounded portions of the booth such as the booth walls. Such arcing in a worse case may lead to fire and explosion. Accordingly, in prior spray booth apparatus, ultraviolet arc detectors have been included which might inhibit or cut off the electrical power to the electrostatic supply under certain conditions. Further, apparatus exists or has been taught in the prior art related to systems for detecting fire in a powder spray booth (see U.S. Pat. No. 4,675,203 to Scarbrough).

One problem often encountered in the use of spray booth apparatus is the difficulty for those responsible for maintenance of the system to determine when maintenance may be needed on particular guns of a gun array or on the spray booth as a whole. In particular, the amount of time which the gun is operating determines the amount of wear and tear on the internal components of the gun which, of course, leads to the need for timely preventive maintenance in order to maintain proper uniformity of coatings on the workpieces to be coated.

Although programmable logic controller based systems have in the past provided some remote interrogation capability via modem, it is believed that such systems were relatively inflexible to use because of the use of the ladder logic in the spray booth apparatus.

Accordingly, what is needed is a flexible control system for a spray booth apparatus which allows real time monitoring of a variety of process conditions at a remote location, including arc and fire detection, humidity sensing of the spray powder, gun history and air pressure backwashing of the filtering system.

SUMMARY OF THE INVENTION

The present invention is directed to a spray booth apparatus including a painting chamber adapted to receive a workpiece to be coated. A paint powder supply system is connected to a spray gun which is positioned to eject paint powder into the painting chamber. A high voltage power supply provides an electrical potential to apply an electrostatic or electrical force to the paint powder particles within the spray booth to carry them into contact with the grounded workpiece. The spray booth apparatus includes a control system having a coating processor and a diagnostic processor. The coating processor controls the electrical or high voltage power supply. A pair of pendant type operator stations located on each side of the spray booth housing control the transverse gun array positions. The coating processor, in turn, controls a gun mover which transversely positions gun arrays with respect to the centerline of the processing booth. The coating processor responds to signals from an optical array located in the front of the spray booth apparatus which indicates the presence and rough size and positioning of a workpiece being introduced into the booth. The coating processor then receives signals from the optical array for tracking the workpiece through the painting chamber to maintain a state indication of each workpiece while within the painting chamber to control gun triggering as well as the application of the electrostatic field. This allows the relatively expensive paint powder to be conserved, reduces clogging of associated filters and clean-up time within the booth when colors are switched.

A diagnostic processor is connected to the coating processor. Both the diagnostic processor and the coating processor are Intel 80x86-based systems which execute a personal computer operating system such as MS-DOS 3.3 and the like. The use of the operating system allows relatively flexible interrupt driven programing to be provided both for the coating processor and the diagnostic processor so that a variety of functions can be performed on a real time basis. This allows rapid response to a variety of fault conditions which might not occur if a programmable logic controller is used. In addition, the flexible use of the DOS-based diagnostic encoding processors allows easy changes to be made in the configuration of the system.

The diagnostic processor is fed with signals from a humidity sensor associated with the coating powder supply system to determine when the humidity exceeds a certain range which may result in deterioration of the coating applied to the workpiece. A pressure sensor also feeds a signal to the diagnostic processor indicative of the pressure head to the roll-away filtering system so that adequate filtering is maintained throughout the entire operation. The diagnostic processor has connected to it a modem for communication via telephone line with a second modem connected to a remote personal computer. The remote personal computer executes software which provides a real time indication of the status of a plurality of valve signals for driving associated valves, each one being associated with a canister in the filter assembly for affecting backwashing of particular canister filters. The remote personal computer also provides an output indication of the paint powder humidity, the pressure head, and an indication of how long each gun has been operating since the last preventive maintenance timer reset so that the remote monitoring of the guns allows one to perform preventive maintenance on the guns according to a schedule and not just by estimation or guess work.

Accordingly, the system provides for superior coating results by the monitoring of process conditions while being able to maintain good preventive maintenance control.

It is a particular aspect of the present invention to provide an apparatus for electrostatic spray painting which includes a flexible digital controller for flexible use.

It is another aspect of the present invention to provide an apparatus for electrostatic spray painting capable of providing a real time remote indication of a plurality of process variables.

It is still another aspect of the present invention to provide an apparatus for electrostatic spray painting which provides an indication of the humidity of the paint powder being used within the system.

Other aspects of the present invention will be obvious to one of ordinary skill in the art upon a perusal of the specification and claims in light of the accompanying drawings.

BRIEF DESCRIPTION OF THE DRAWINGS

FIGS. 5A through 5H comprise a single schematic diagram of a pair of gun controllers and associated circuitry;

FIGS. 6A through 6I are schematic diagrams of a spray booth wiring diagram and associated circuitry including a serial communications system;

DETAILED DESCRIPTION OF THE PREFERRED EMBODIMENTS

Figure 1:
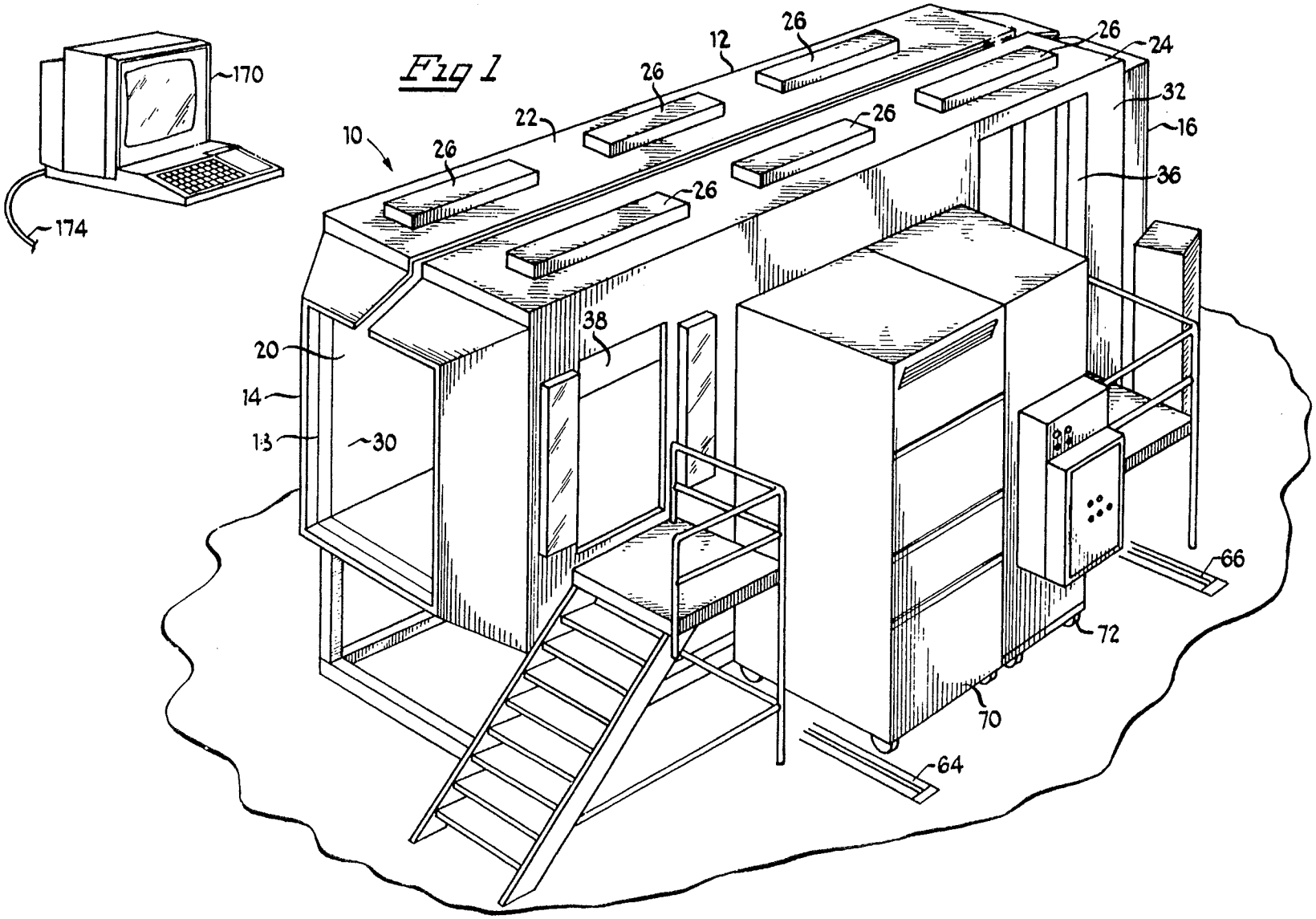
FIG. 1 is a perspective view of an apparatus for electrostatic paint spraying embodying the present invention.

Referring now to the drawings and especially to FIG. 1, apparatus for electrostatic spray painting is shown therein and generally identified by numeral 10. The apparatus for electrostatic spray painting includes a spray booth housing 12 having an inlet 14 and an outlet 16. An optical array 18 is positioned at the housing inlet 14 for detection of workpieces as they enter a painting chamber 20 defined by the housing 12. The housing 12 includes a divided top wall having a first clear acrylic top wall section 22 and a second clear acrylic top wall section 24. A plurality of rectangular light fixtures 26 is positioned in the top walls 22 and 24 in order to illuminate the painting chamber 20. A side wall 30 is connected to the top wall 22. A side wall 32 is connected to the top wall 24. A gun array access opening 36 having a substantially rectangular shape is formed in the side wall 32 for receipt of a spray gun array. An operator inspection opening 38 is also formed in the side wall 32.

Figure 2:
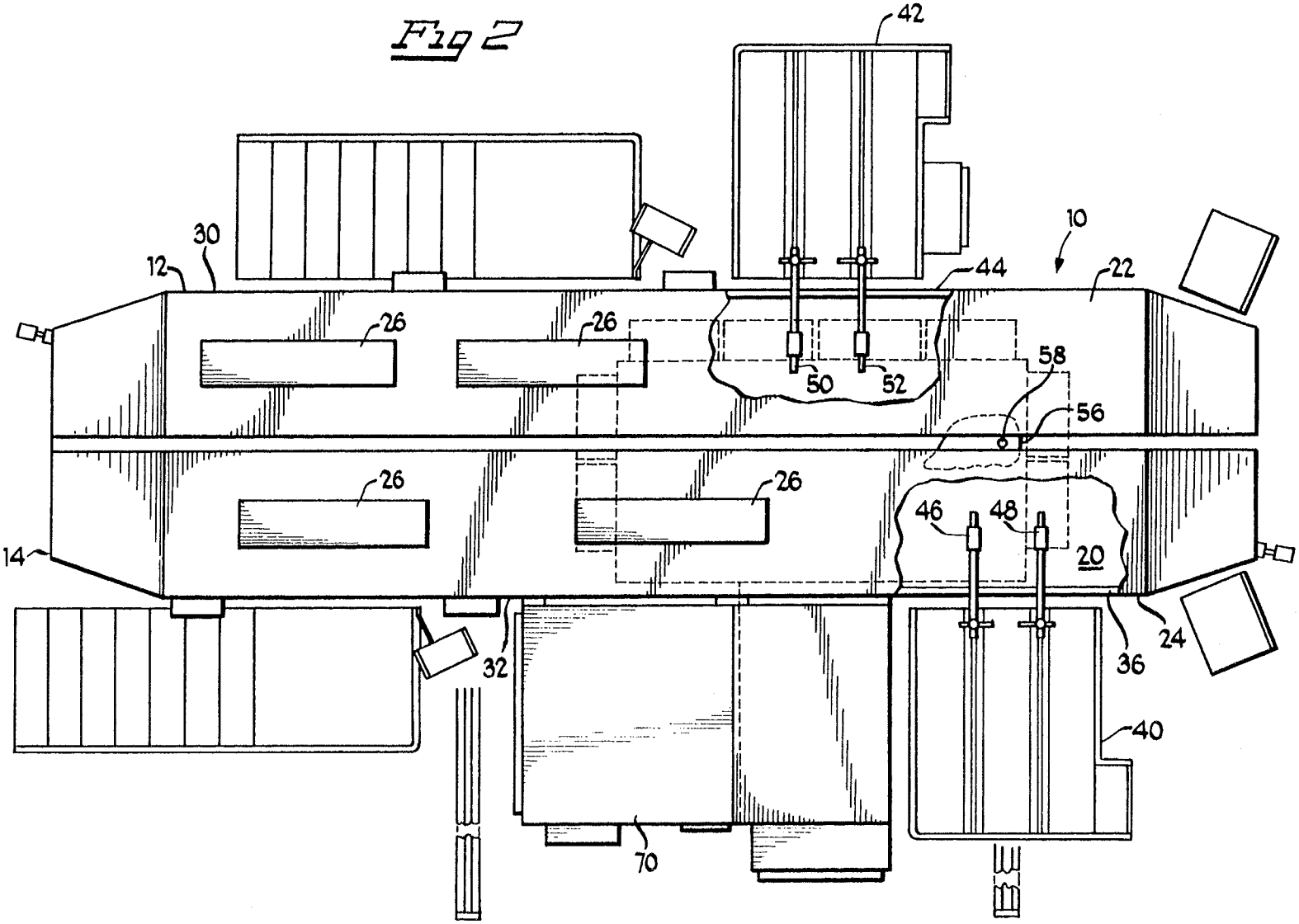
FIG. 2 is an elevational view of the apparatus shown in FIG. 1 with a pair of gun arrays in operative position for painting a workpiece.

As may best been seen in FIG. 2, a spray gun array 40 is positioned proximate with the opening 36. A gun array 42 is positioned on the opposite side of the spray booth housing 12 at the side wall 30 adjacent a gun array opening 44. A first paint powder delivery system **41*a* is connected to the gun array 40. A second paint powder delivery system 41*b* is connected to the gun array 42. Both paint powder delivery systems 41*a* and 41*b* store paint powder and supply it to their respective gun arrays. The gun array 40 includes a pair of spray guns 46 and 48 which are positioned within the painting chamber 20. The gun array 42 includes a pair of spray guns 50 and 52, also positioned within the painting chamber 20. It may be noted that the spray guns are located on opposite sides of a centerline of the painting chamber 20 along which a workpiece 56 suspended from a movable hanger bracket 58 is advanced by a well-known advancing mechanism, not shown herein. A pair of spray booth tracks 64 and 66 are mounted on the floor for movement of the spray booth housing 12** horizontally.

A removable filter assembly 70 includes a roller mount 72 for movement of the filter assembly 70 toward and away from the side wall 32. The filter assembly 70 includes a plurality of canister filters of the type disclosed in U.S. Pat. No. 5,107,756 to Diaz, the contents of which are incorporated herein by reference.

Figure 4:
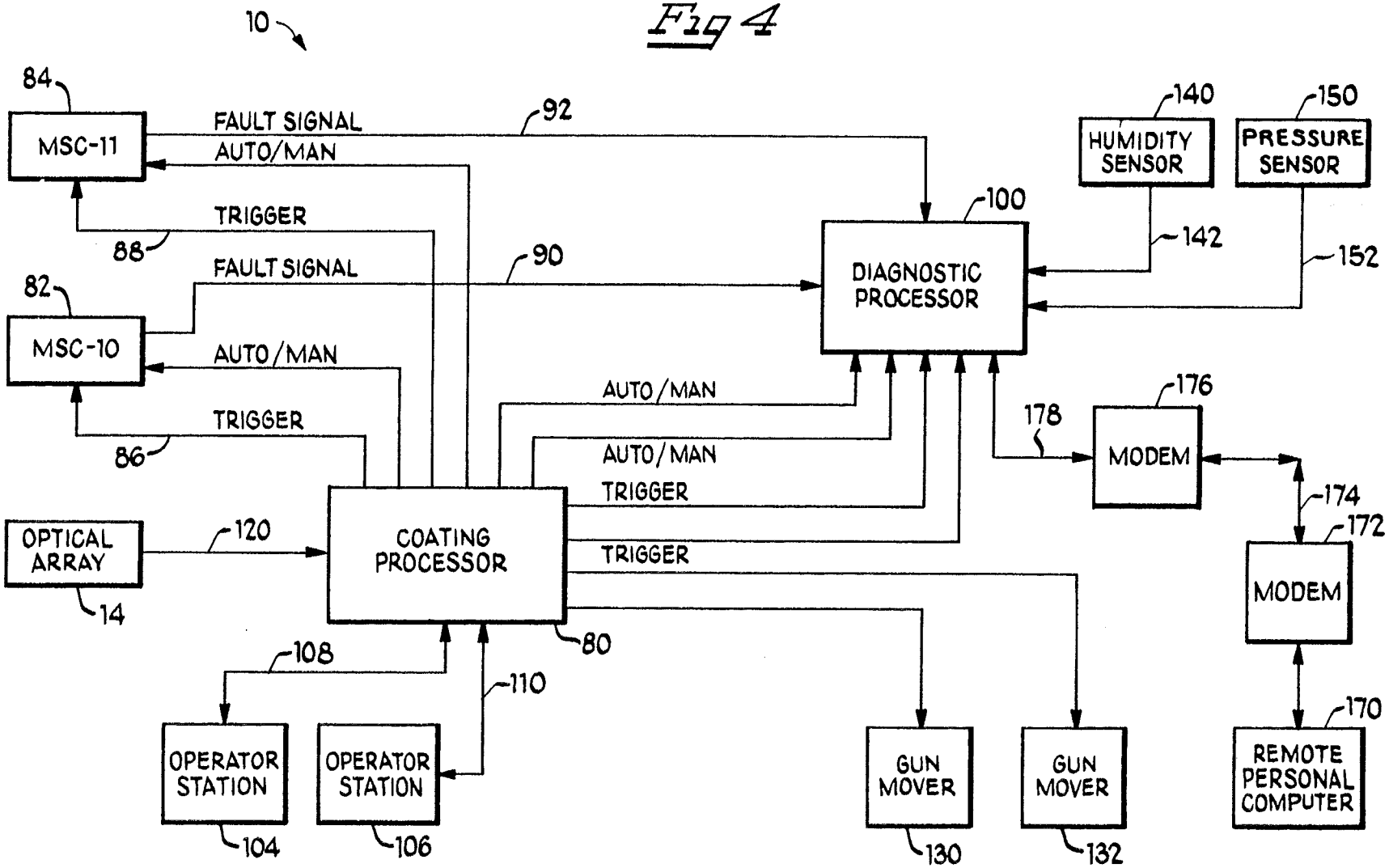
FIG. 4 is a schematic diagram of a portion of the inventive apparatus shown in FIG. 1.

Referring now to FIG. 4, a portion of the apparatus 10 is shown therein in schematic form and includes a coating processor 80 which is connected to a pair of gun controllers 82 and 84. Gun controller 82 is positioned on a first side of the spray booth housing 12. Gun controller 84 is positioned on a second side of the spray booth housing 12. The coating processor 80 controls energization of the electrostatic energy to the spray guns, as well as control of paint powder flow to the spray guns, via a pair of respective trigger lines 86 and 88. In the event that there is a gun fault, usually indicated by arcing detected by the ultraviolet or arcing detectors associated with controllers 82 and 84, fault signals are generated on lines 90 or 92 which are fed to a diagnostic processor 100. The coating processor 80 also receives signals from a pair of pendant-type operator control stations 104 and 106 connected by respective lines 108 and 110 to the coating processor 80. The optical array 18 is connected via a line 120 to the coating processor 80 to provide the coating processor 80 with workpiece position and configuration signals when a workpiece is introduced at the inlet 14.

The coating processor 80 also controls a pair of gun movers 130 and 132 which traverse the gun arrays 40 and 42 to allow the guns to be optimally positioned with respect to workpiece surfaces to be painted transversely with respect to the painting chamber 20.

In order to determine a process condition of the paint powder, condition responsive means is provided which include a humidity sensor 140 coupled via a humidity signal line 142 to the diagnostic processor to provide a humidity signal related to the humidity of the gun drive air thereto. A pressure sensor 150 is also part of the process condition responsive means and is connected via a pressure signal line 152 to the diagnostic processor 100 as well. A remote personal computer 170 is connected via a modem 172 over a telephone line 174 to a diagnostic processor modem 176 connected via a line 178 to the diagnostic processor 100. The screen of the remote personal computer 170 may best be seen in FIG. 3 as will be discussed in detail hereinafter.

Figure 6H:
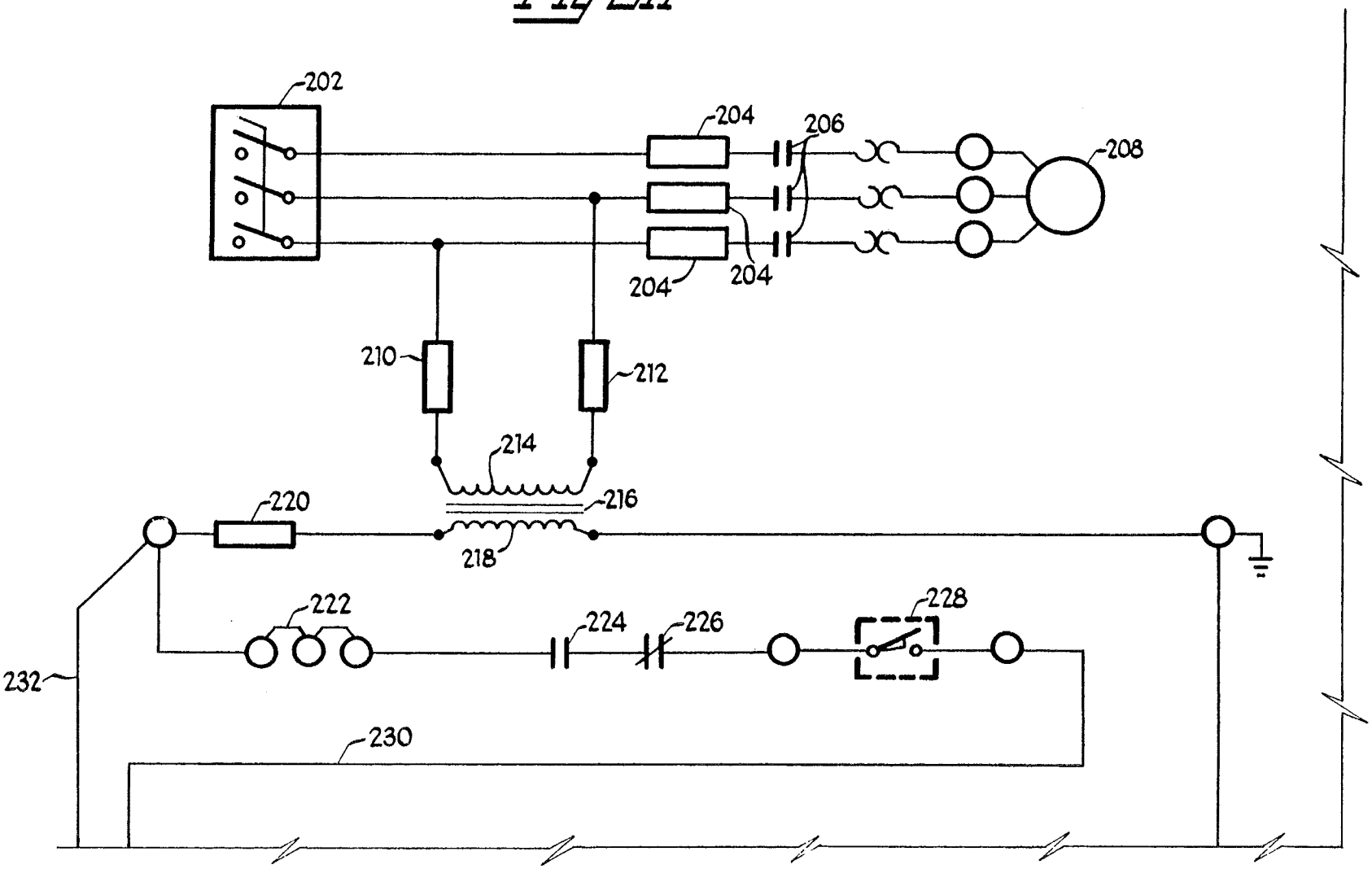

Referring now to FIGS. 6A through 6I, the overall wiring diagram for the apparatus 10 is shown therein. Referring now in particular to FIG. 6A, a 60-amp switch 202 feeds current through a plurality of fuses 204 and contacts 206 to a recirculation fan motor 208 for driving recirculating air through the spray booth. A pair of fuses 210 and 212 are connected to a primary winding 214 of a transformer 216 whose secondary winding steps 218 down the input voltage from 575 volts to 115 volts. The secondary winding drives a fuse 220 which feeds current through an interlock circuit 222 to a pair of ultraviolet fire detectors 224 and 226. Current is also fed through a limit switch 228 which detects the positioning. The limit switch 228 remains closed when the filter assembly 70 is in the proper position. Current is then fed through a line 230. Meanwhile, a potential is also fed through a line 232. The line 230 feeds a start fan switch 234 and a stop fan switch 236. A vacuum sensing switch 238 is coupled to the collector 70 and closes on vacuum increase to 2 inches of water column. Connected to the switch 236 is a switch 240 for a final filter portion of the filter assembly 70 which opens when the pressure increases to 3.5 inches. Likewise, a switch 242 closes when the pressure increases to 1.5 inches of mercury as measured by a water column. A red lamp 244 is illuminated when the switch 242 is closed. A green lamp 246 is illuminated when the motor 248 for the recirculating fan is also operable. An air solenoid 250 is connected between the line 249 and a line 251 to control high pressure air. An electronic timer assembly 260 is connected via a power line 262 to receive electrical energy from the line 251 and serves to cycle a plurality of pulsating solenoid valves generally referred to by numeral 262*a*. Each of the pulsating solenoid valves is associated with a particular filter canister in the collector filter assembly 70. It may be appreciated that the pulse signals are generated on a pulse bus generally identified by numeral 264, which is also coupled to a 120 volt pulse check opto-coupler 266. An alarm circuit 270 is coupled to the lead 251 and includes an alarm cut-off switch 272. The switch is coupled to a line 274 which feeds the opto-coupler 266 for coupling an "add powder" signal generated by a detector 278 to which is connected a low-level buzzer 280 which is actuated when the detector sensor switch 284 closes upon the sensing of a low powder level. The switch 284 is driven from a suitable source of 24 volt potential.

Figure 6B:
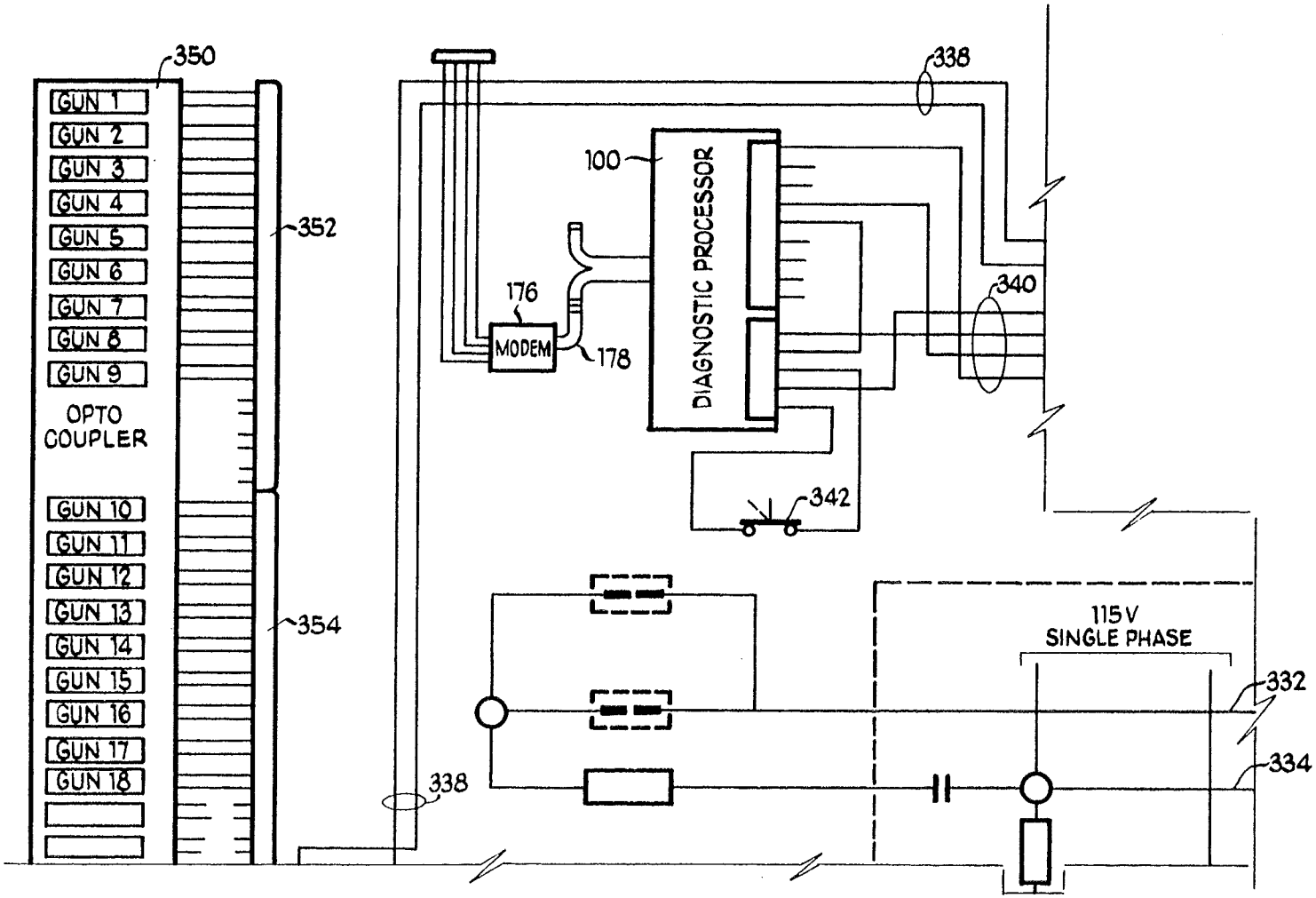
Figure 6C:
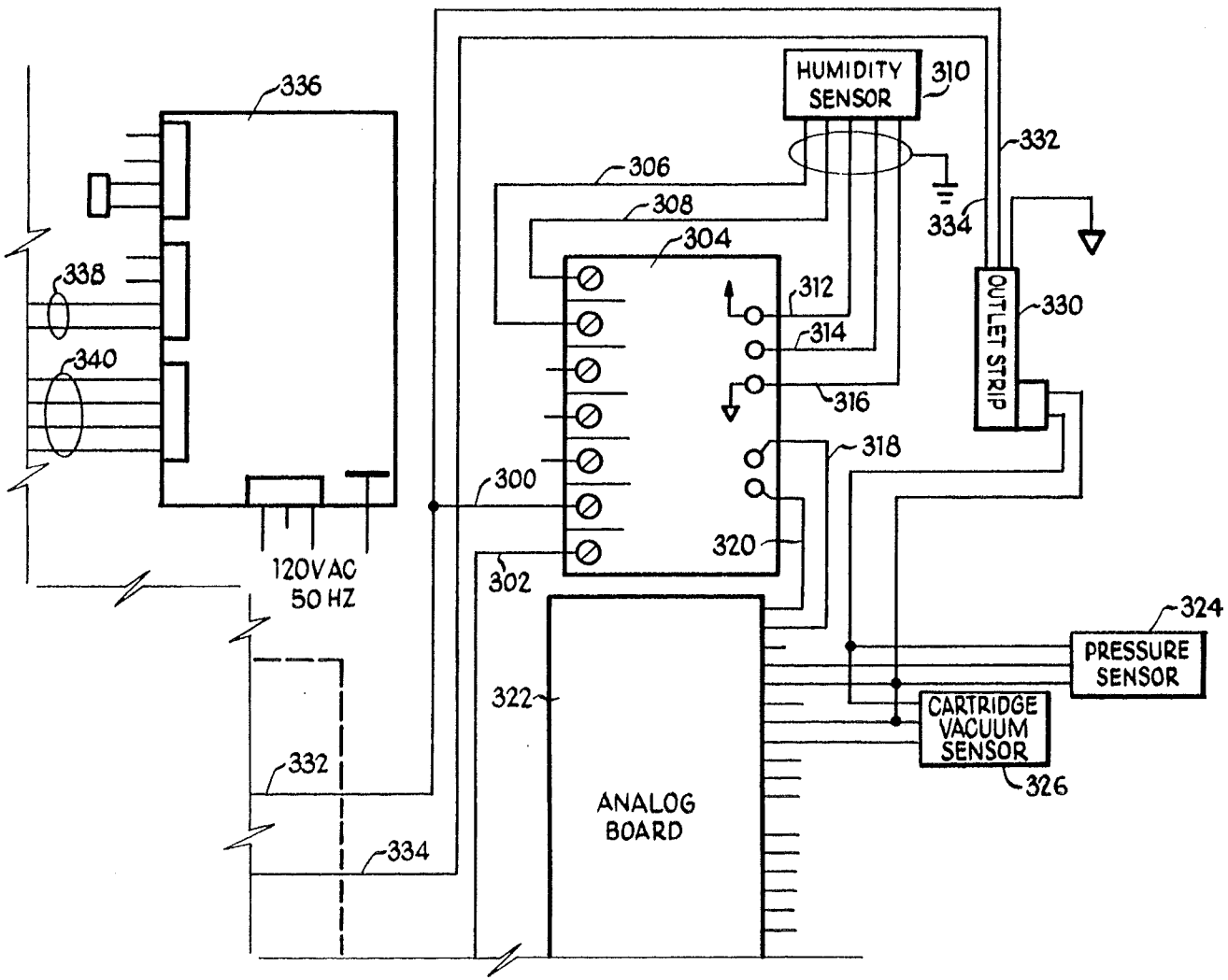
Figure 6D:
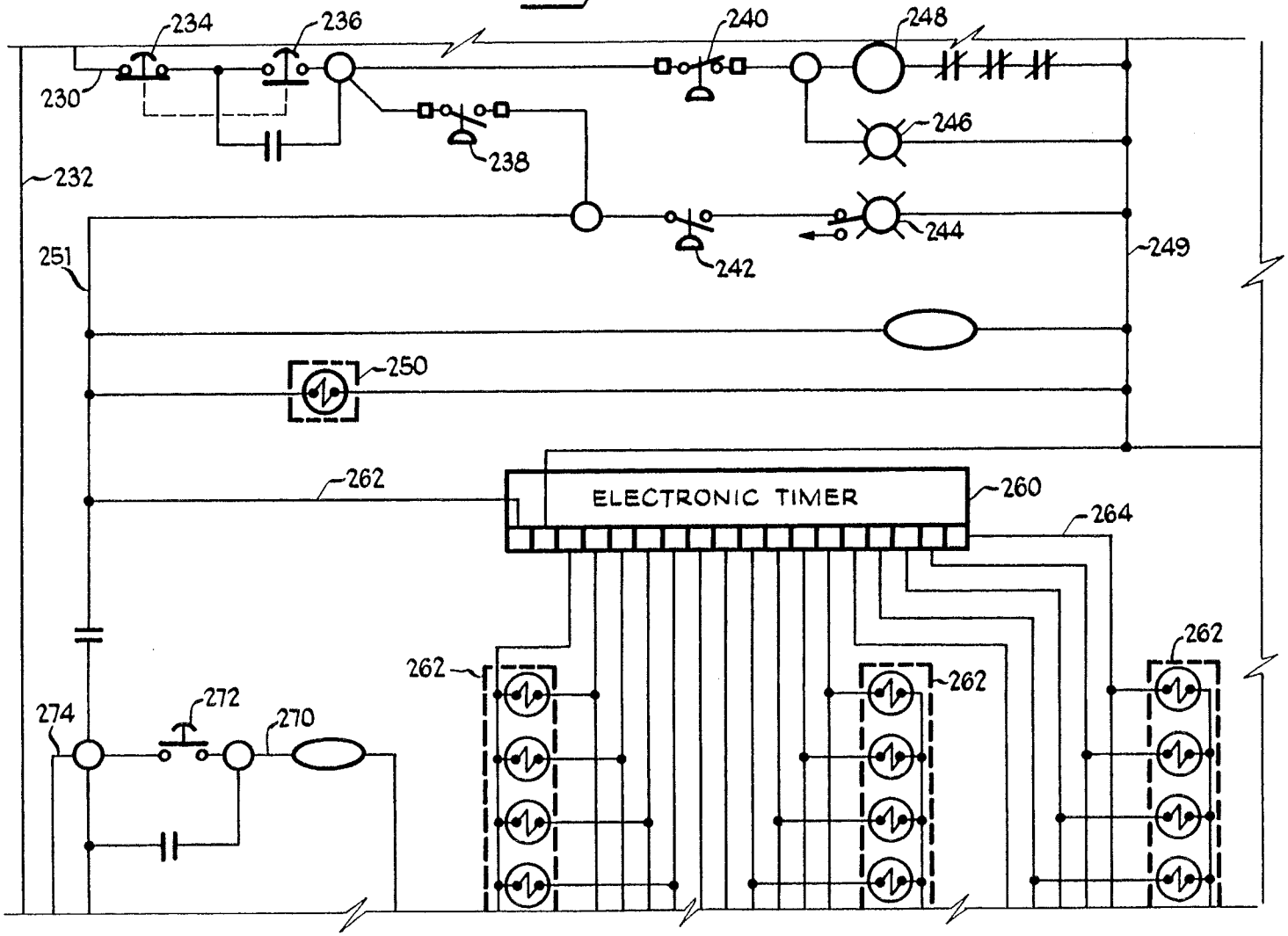
Figure 6E:
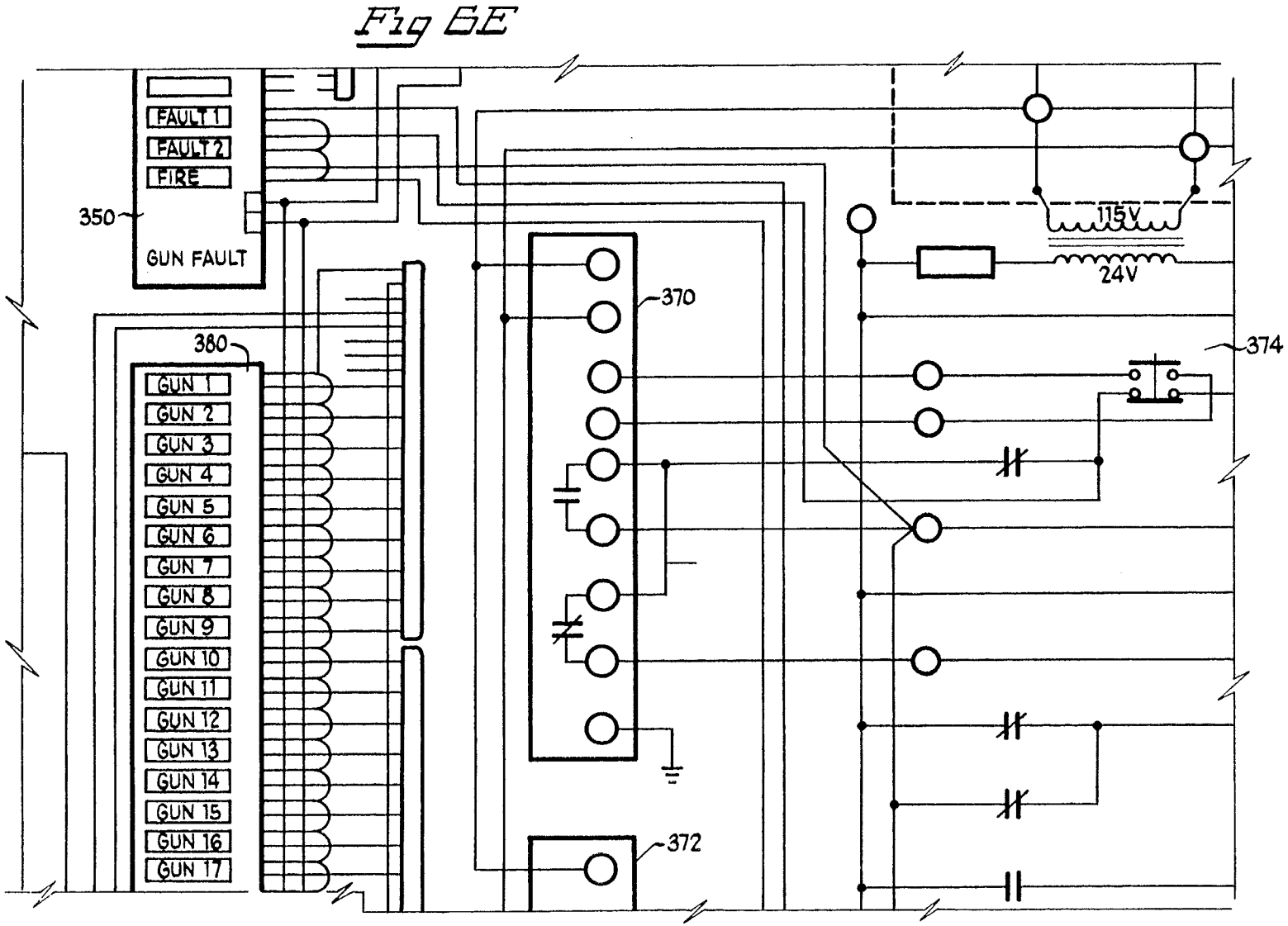

Referring now to FIG. 6C a 120 volt AC feed along a pair of lines 300, 302 drives an SC-120T card 304 of the type available from Ohmega Engineering. The card 304 supplies a drive signal on leads 306 and 308 to a humidity sensor 310 for sensing the drive air humidity. Sensor signals are returned on leads 312, 314 and 316. An output signal indicative of the humidity is provided on leads 318 and 320 to an analog board 322 which also receives inputs from a cartridge filter vacuum sensor 324 and a final filter pressure sensor 326. All of those analog inputs from the humidity sensor and the two pressure sensors are then fed to a suitable digital processor, as will be seen hereinafter. The power for the 120 volt AC is supplied from a conventional outlet strip 330 connected via leads 332 and 334 to leads 300 and 302. A 12 volt supply 336 is available to supply a 5 volt signal on a pair of leads 338 and a $\pm 12$ volt as well as a 5 volt signal on leads 340. The leads 340 drive the diagnostic processor 100. A diagnostic processor on/off switch 342 is also connected to the diagnostic processor 100. Also shown on FIG. 6B is a gun fault optical coupler comprising an opto 22 optical coupler and identified by numeral 350 which is fed from a pair of buses 352 and 354 from a pair of the gun controllers 130 and 132.

A first ultraviolet detector 370 on one side of the booth and a second ultraviolet detector 372 are energized by 120 volts AC and feed fault signals to a ladder logic section 374 which includes a buzzer 376 for an audible output of UV faults as well as a fire alarm 378 which is sounded in response to actuation of the detectors. Also, as may best be seen in FIGS. 6E and 6H, an additional opto 22 optical coupler 380 for transferring gun triggering signals to and from the gun controllers 130 and 132 is provided.

Figure 5A:
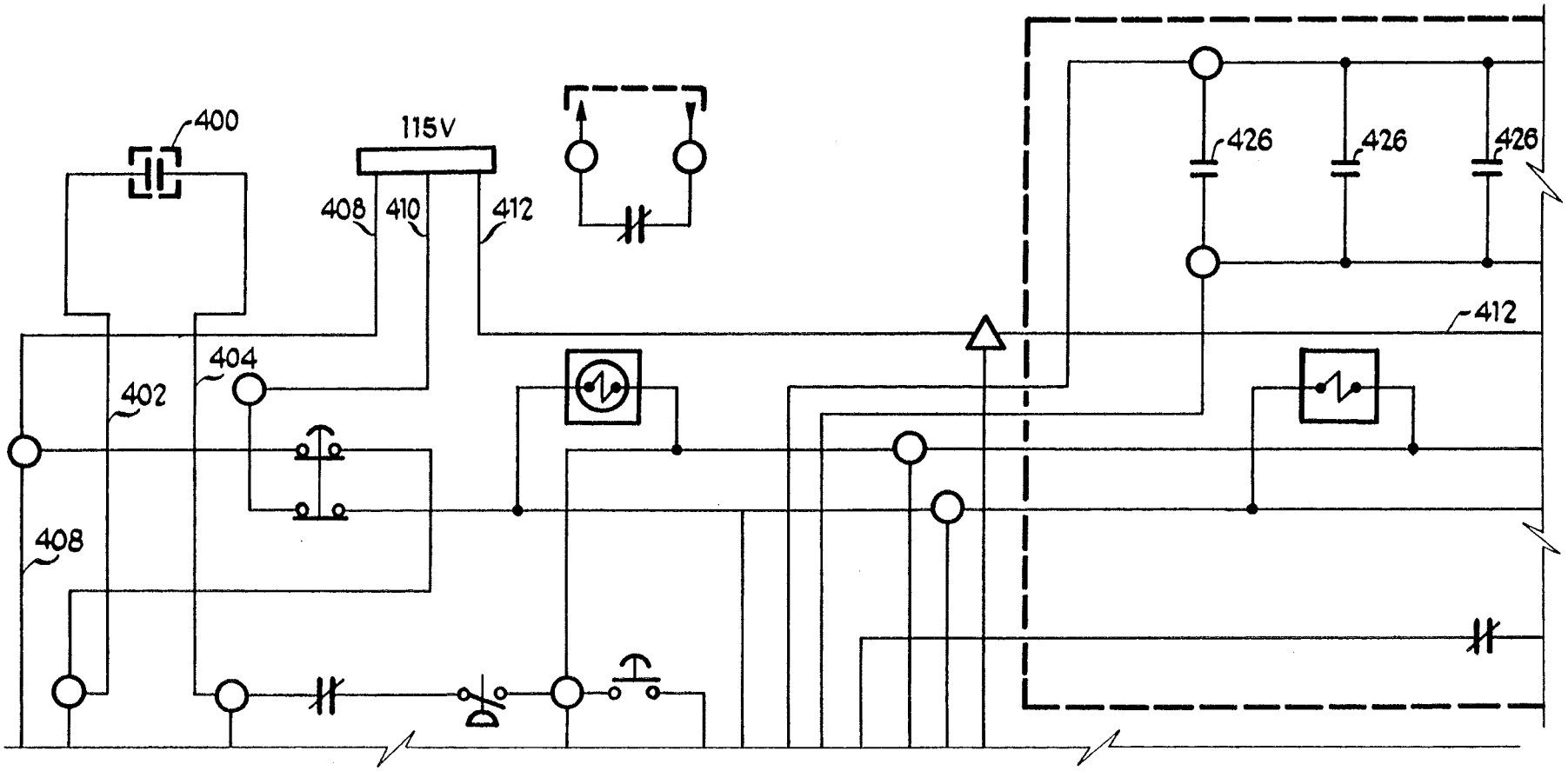
Figure 5B:
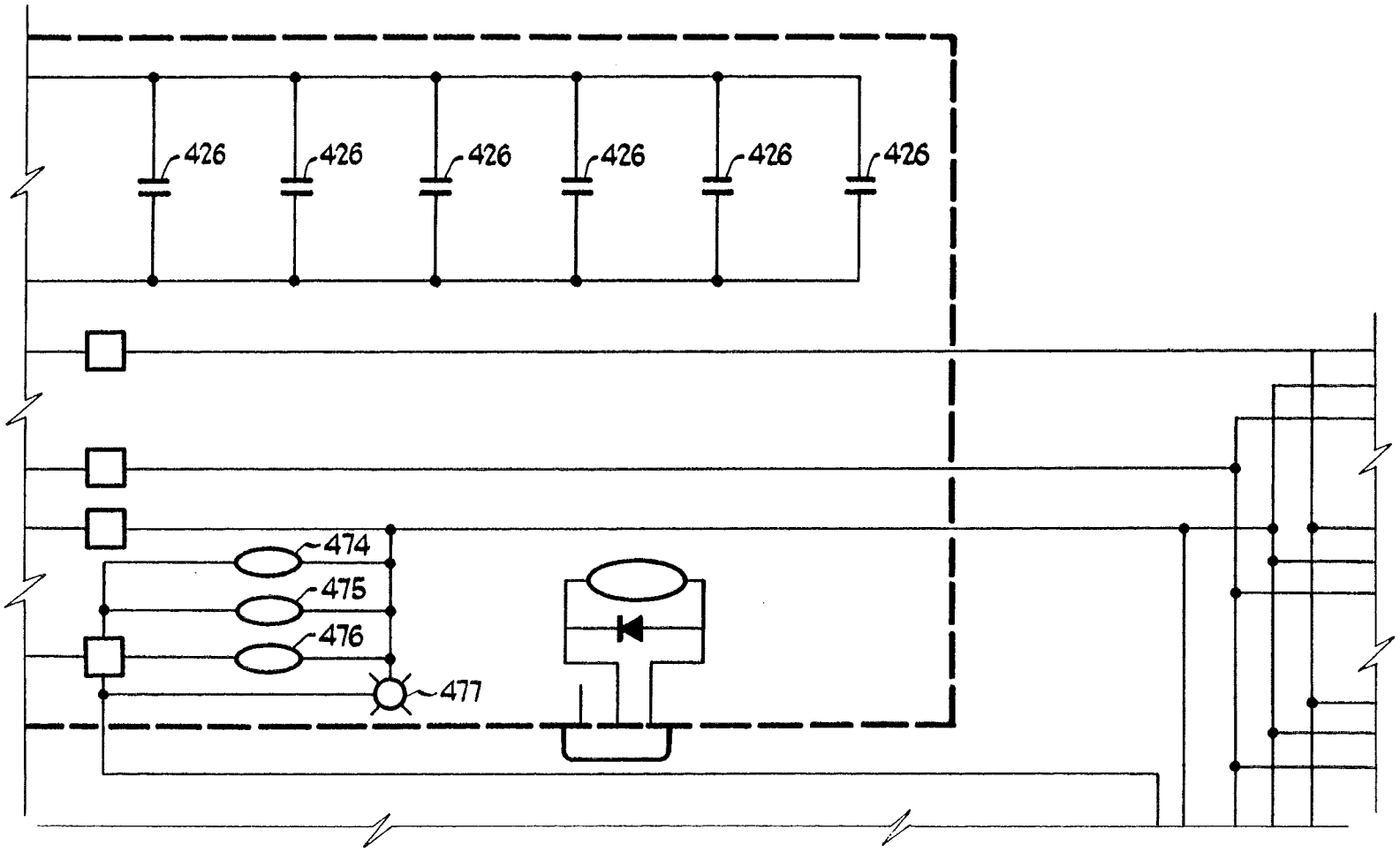
Figure 5C:
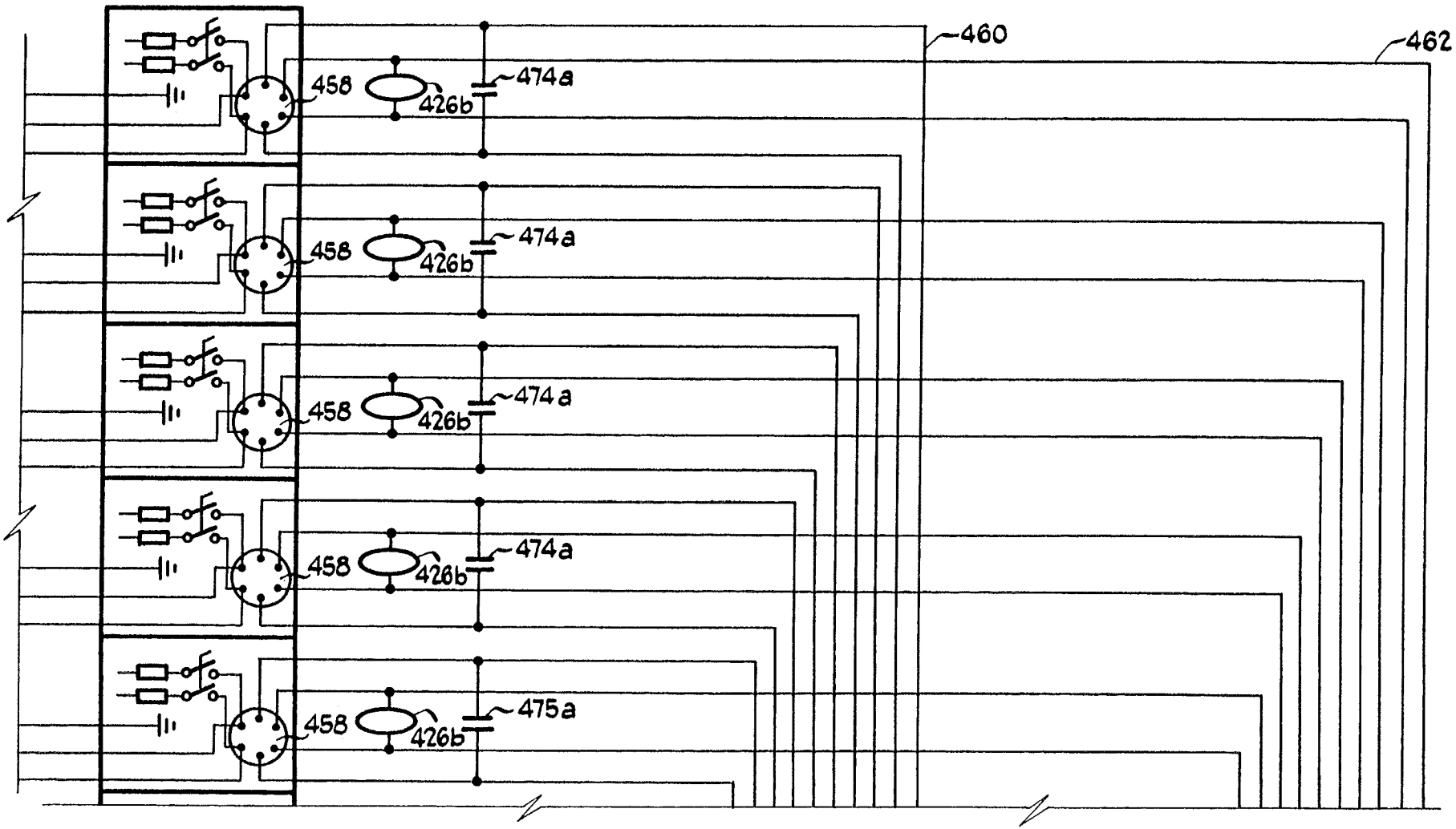
Figure 50:
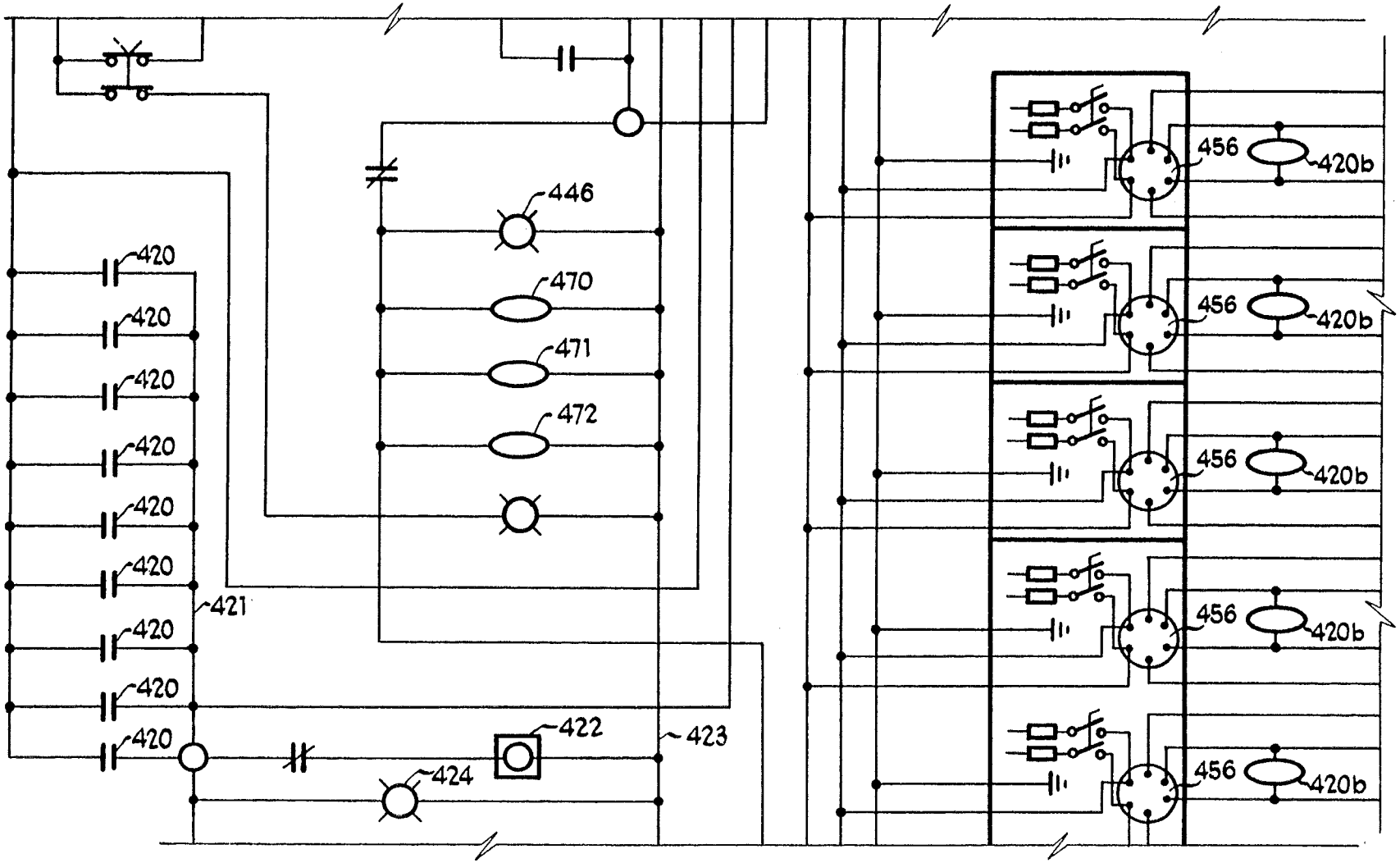
Figure 5E:
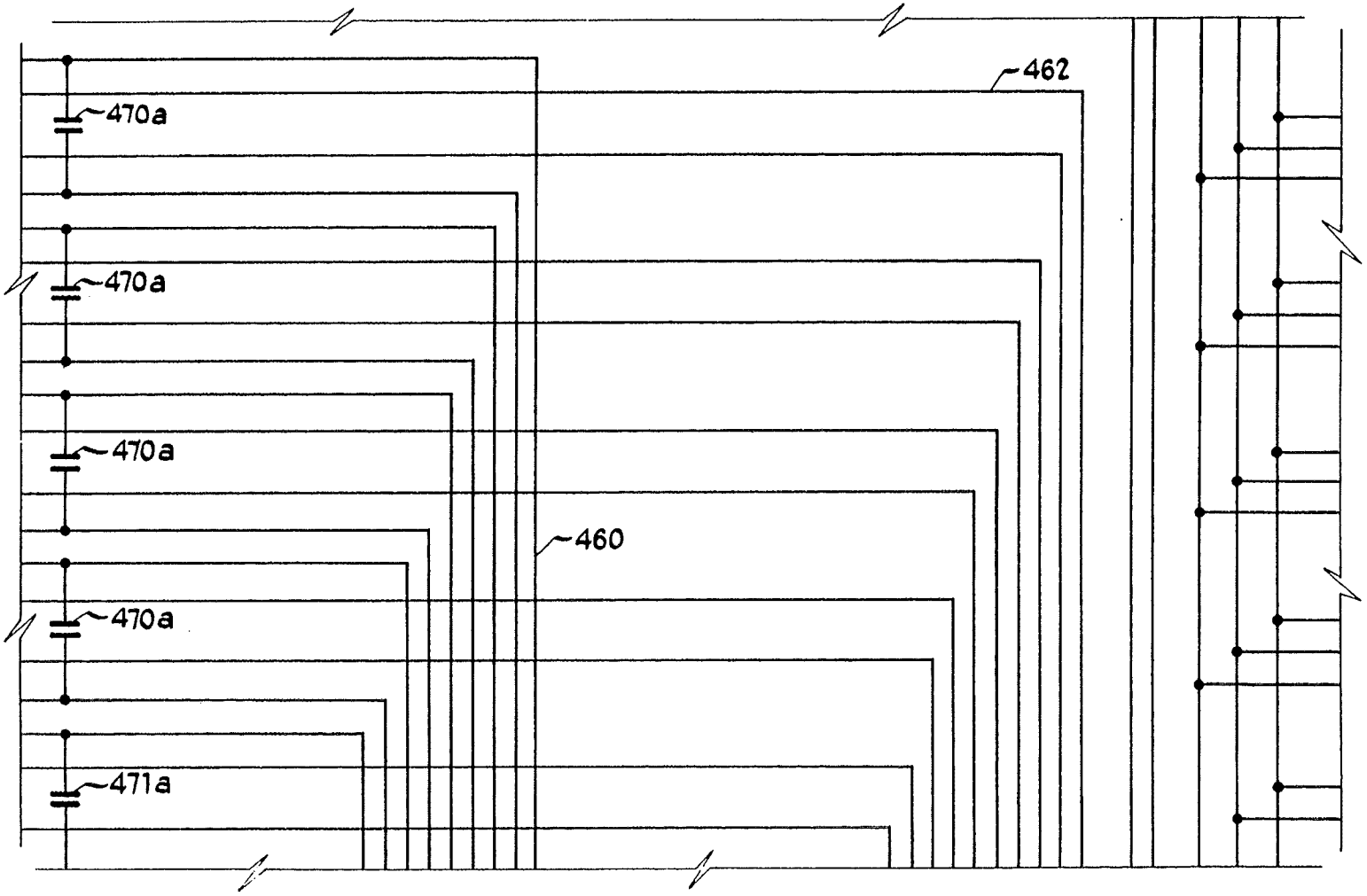
Figure 5F:
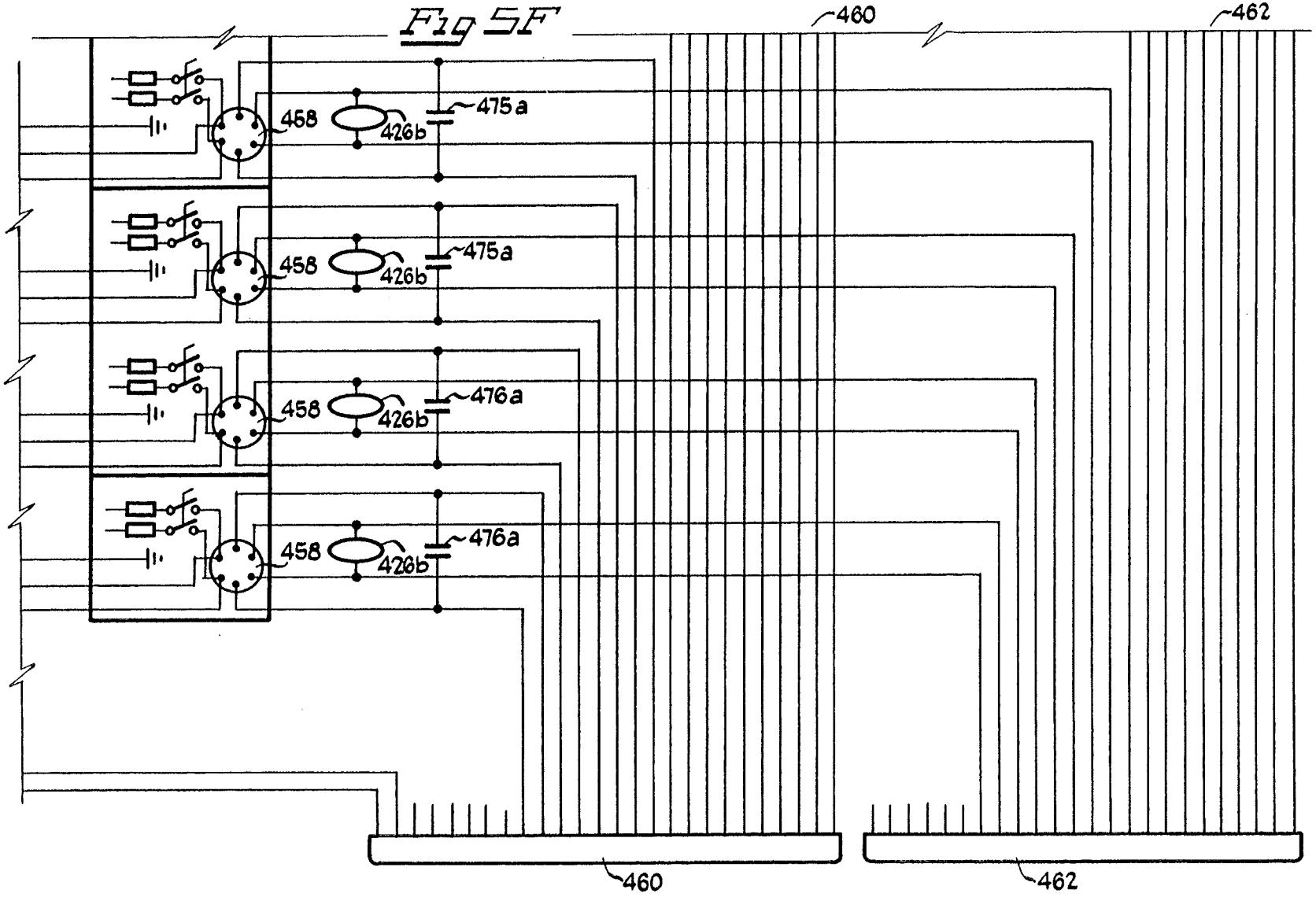
Figure 5G:
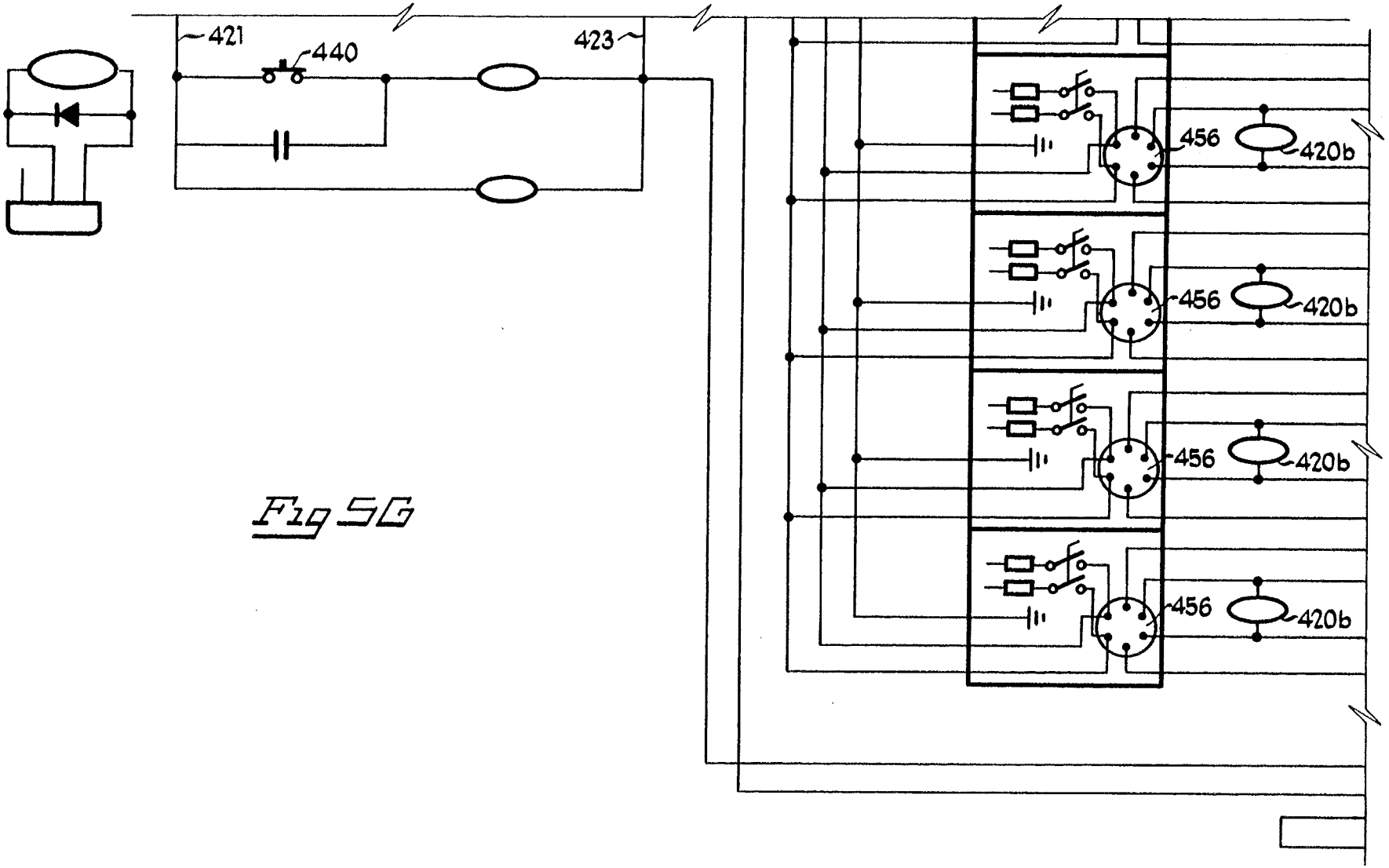
Figure 5H:
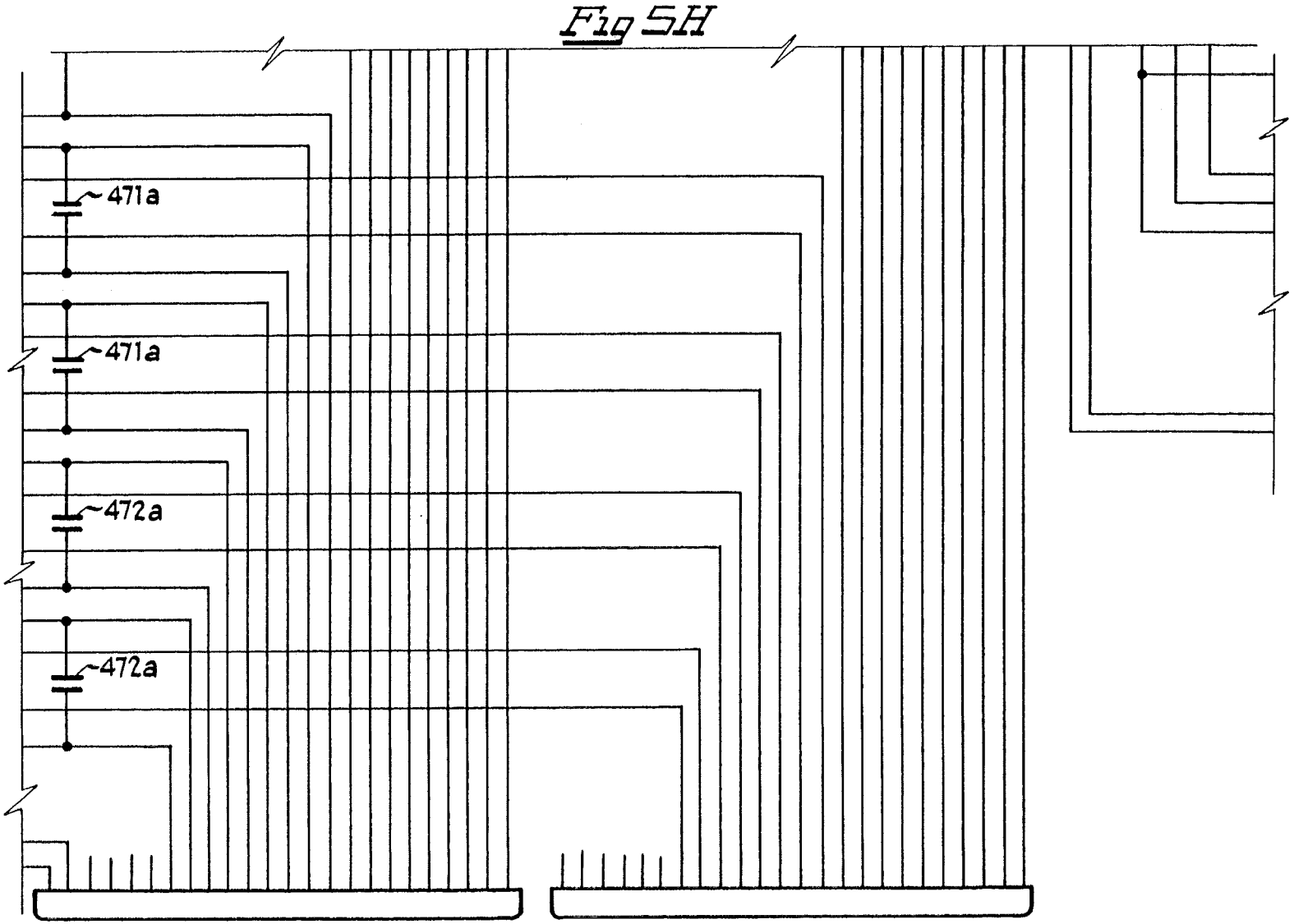

Referring now to FIGS. 5A through 5H, trigger connectors are generally shown thereon connecting control signals to the gun controllers 1 through 8 and 10 through 18. Guns 1 through 8, for instance, are associated with the first gun array. Guns 10 through 18 are associated with the second gun array. Referring now specifically to FIG. 5A, a conveyor interlock 400 is shown thereon which detects when the conveyor carrying the workpiece stops and interrupts power and air to the guns if the conveyor stops. The conveyor interlock is connected to a pair of lines 402 and 404. A source of 115 volt AC from the booth is fed by a plurality of lines 408, 410 and 412. Line 412 is established as a ground line. A plurality of contacts 420 is provided connected in parallel one or more of which are closed when a gun fault indicative of a large current draw by a possible unwanted short, such as arcing or the like. When any of the contacts close, a buzzer 422 and also a gun fault light 424 is illuminated. A similar set of contacts may best be seen in FIGS. 5A and 5B and are identified as contacts 426, one or more of which will be actuated as a result of a gun fault. Likewise, when contacts 426 are actuated, the buzzer 422 sounds and the gun fault light 424 is illuminated. Also associated with the gun fault light 426 and alarm is a switch 440 which is used to silence the alarm. When the guns are energized, a lamp 446 is illuminated indicating that power is being supplied to the guns. The first plurality of guns are energized through a plurality of gun connectors 456 which, among other things, supply the high voltage to the guns for producing the electrostatic field. The guns located in the second array on the opposite side of the spray booth are energized by being triggered through a plurality of connectors 458. It may be appreciated that the energization signals from the gun controllers themselves, as may best be seen in FIG. 5F, are fed to a first gun bus 460 and to a second gun bus 462, as is well known in the art. It should be appreciated that a plurality of gun state detectors 420*b* is associated with each of the gun connectors 456 for controlling the contact closures 420 to indicate that a gun fault has occurred. Likewise, a plurality of detectors 426*b* is associated with lines controlling the gun connectors 458 and which when sensing a gun fault condition, usually a large current draw, will cause one or more of the contacts 426 to close indicating an alarm condition. Furthermore, a plurality of normal gun condition activating sensors 470, 471 and 472 controls respective enabling contacts 470*a*, 471*a* and 472*a*. Likewise, a plurality of enabling sensors 474, 475 and 476 which are associated with a lamp 477 enable into an open position the contacts 474*a*, 475*a* and 476*a* associated with gun control terminals 458.

Figure 8A:
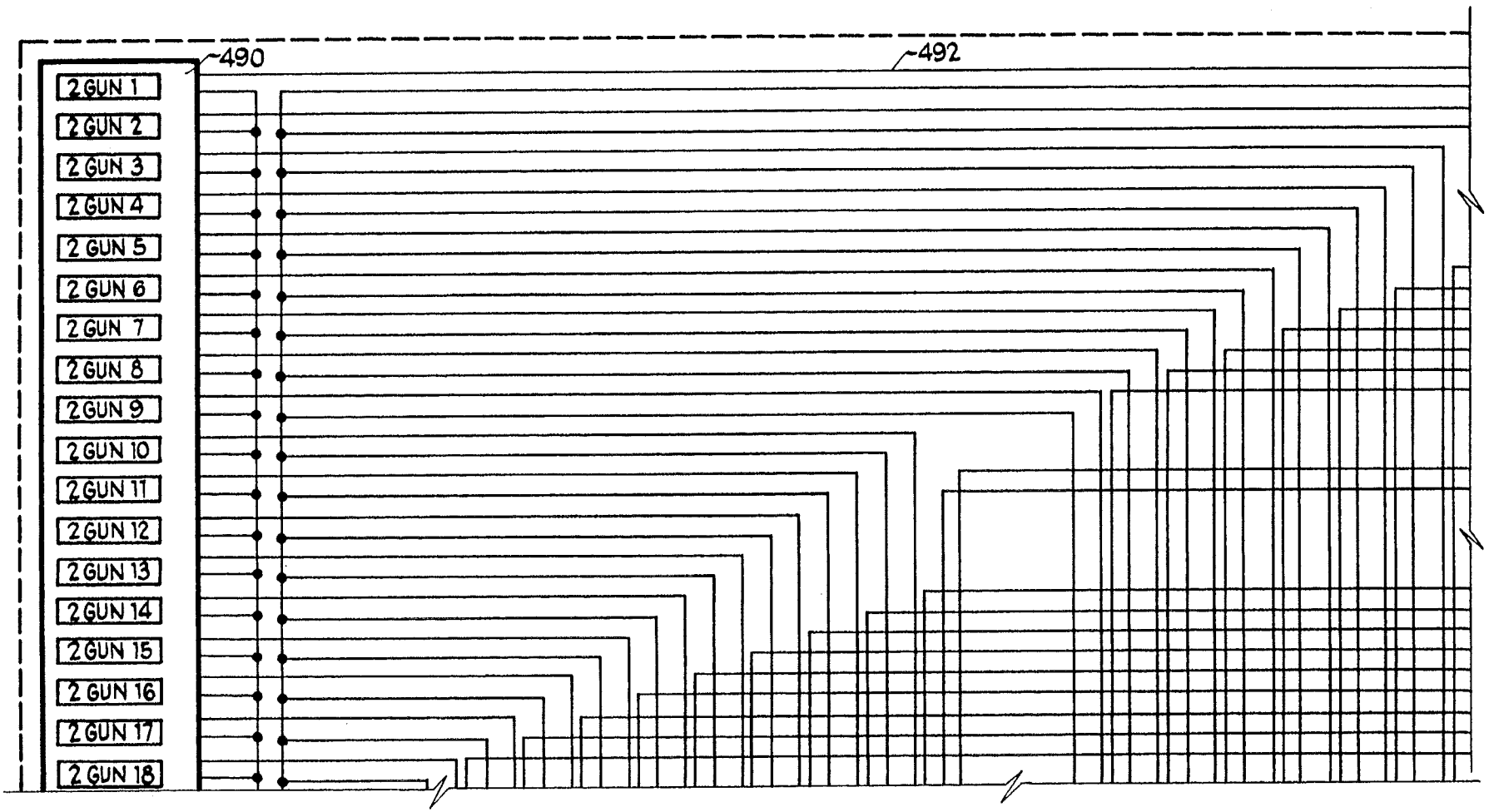
Figure 8B:
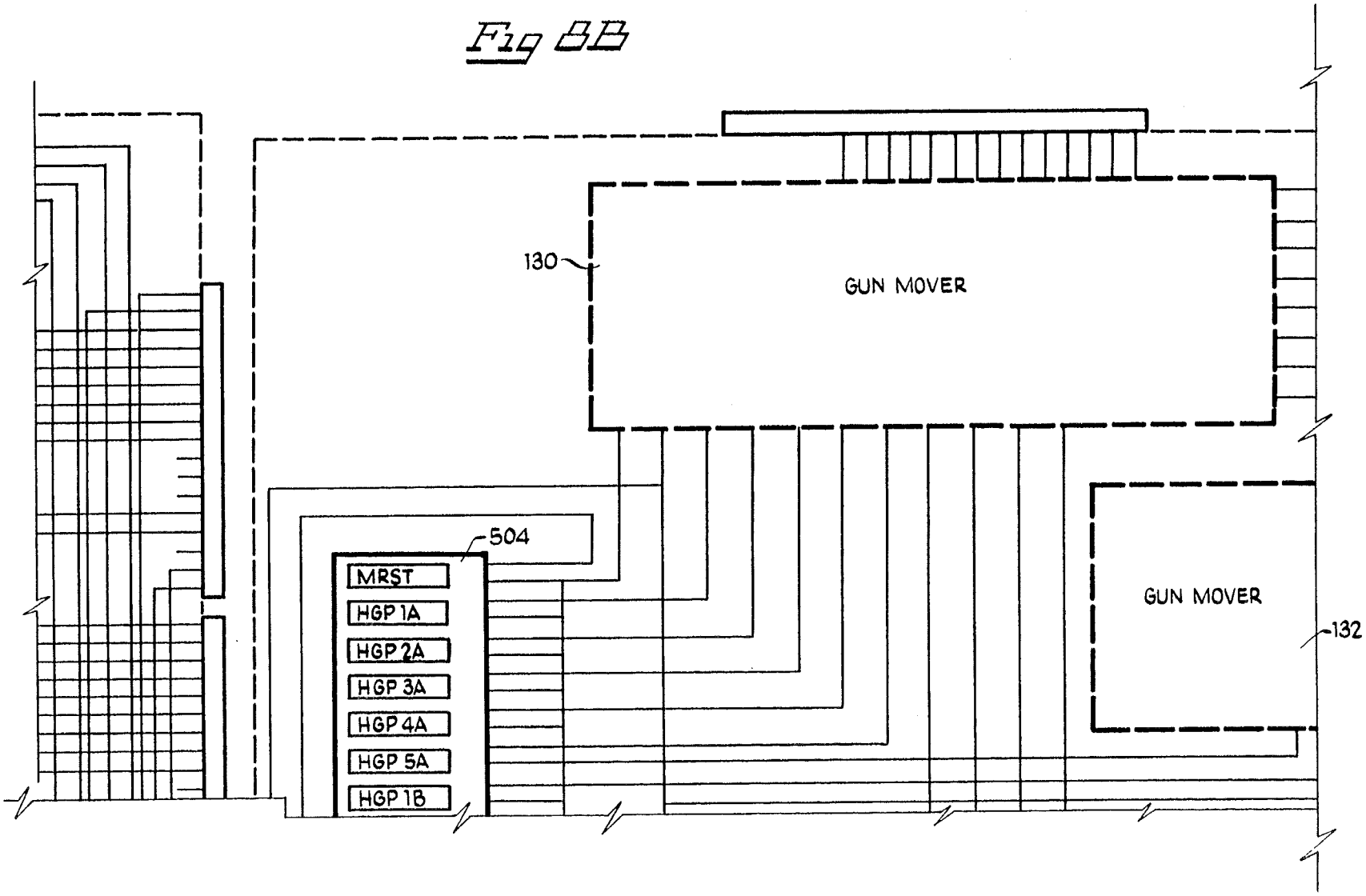
Figure 8C:
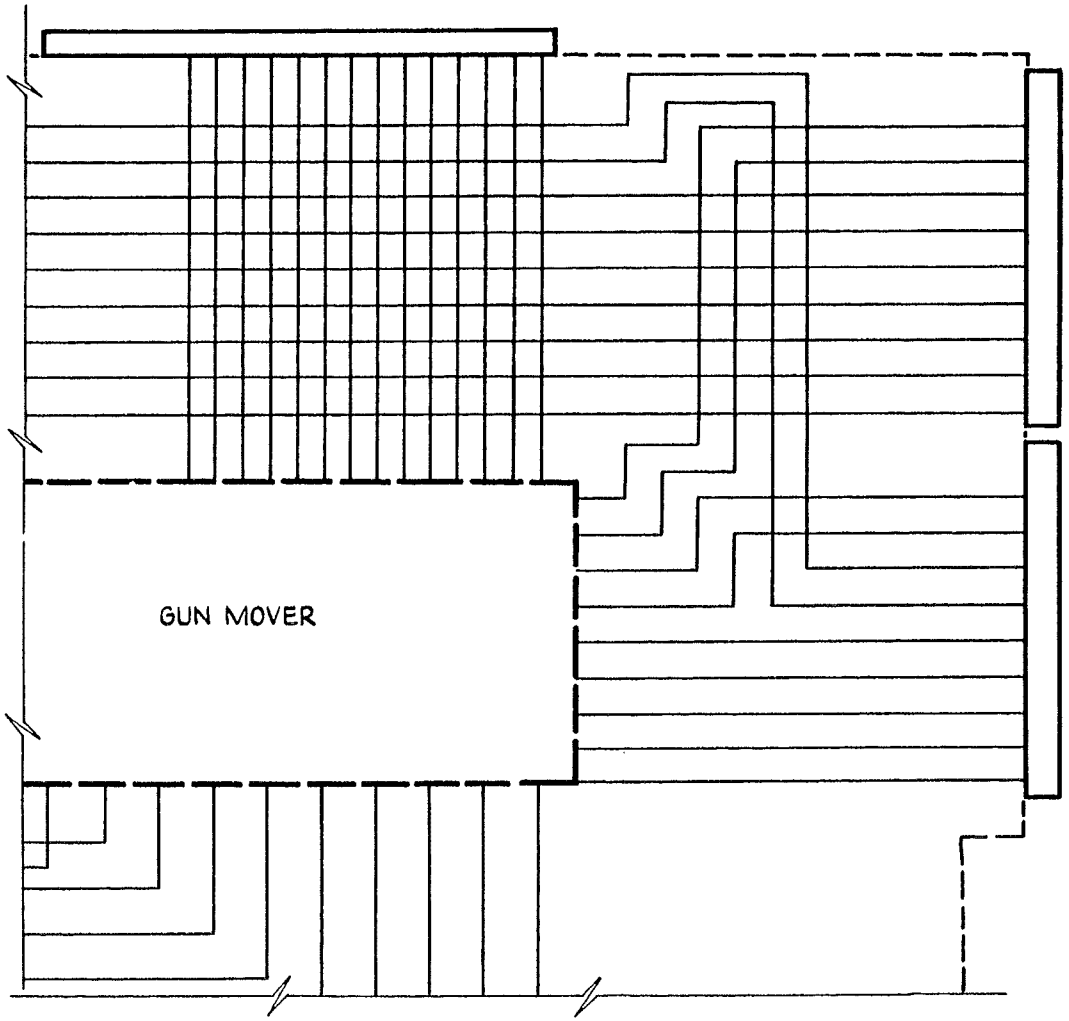
Figure 8D:
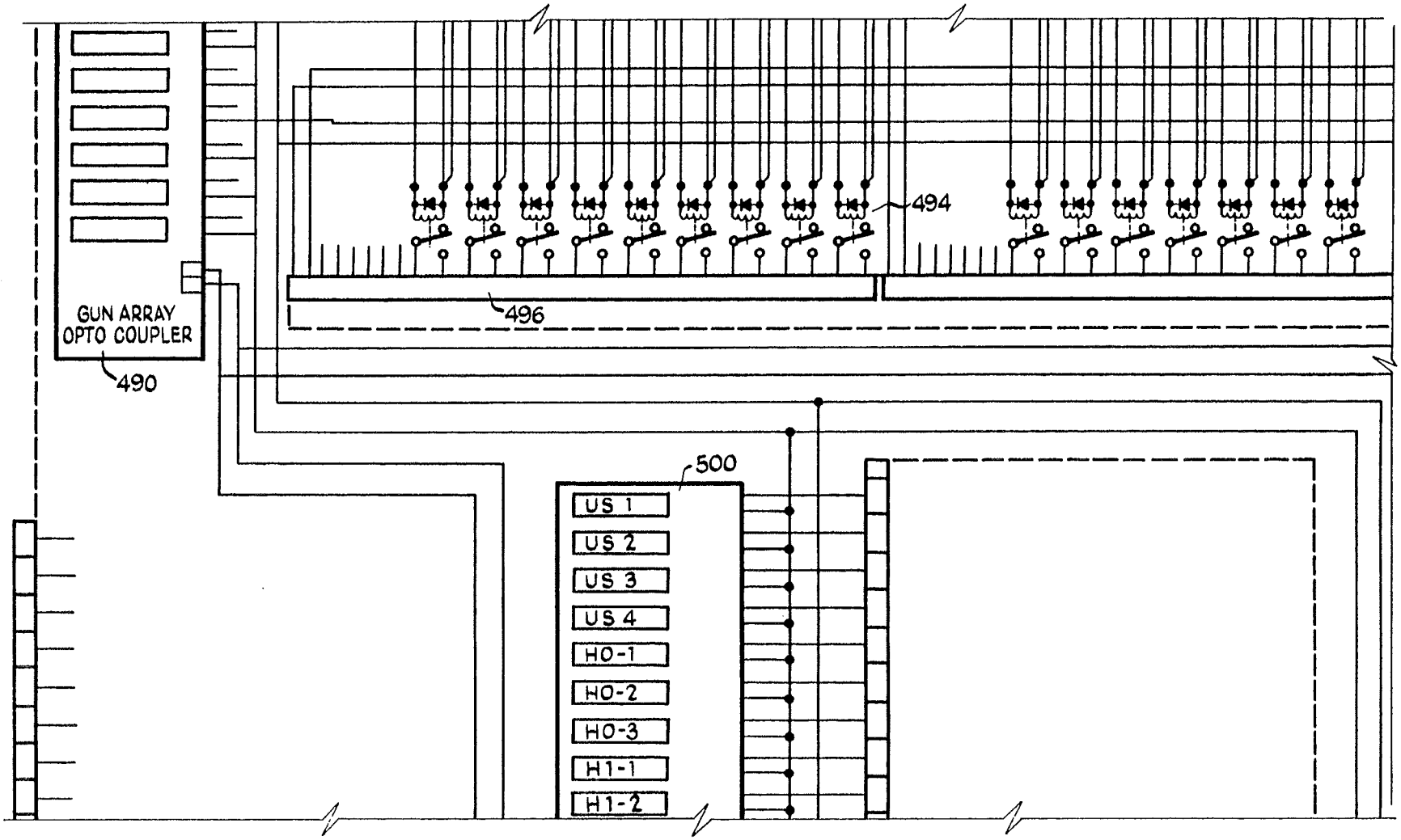
Figure 8E:
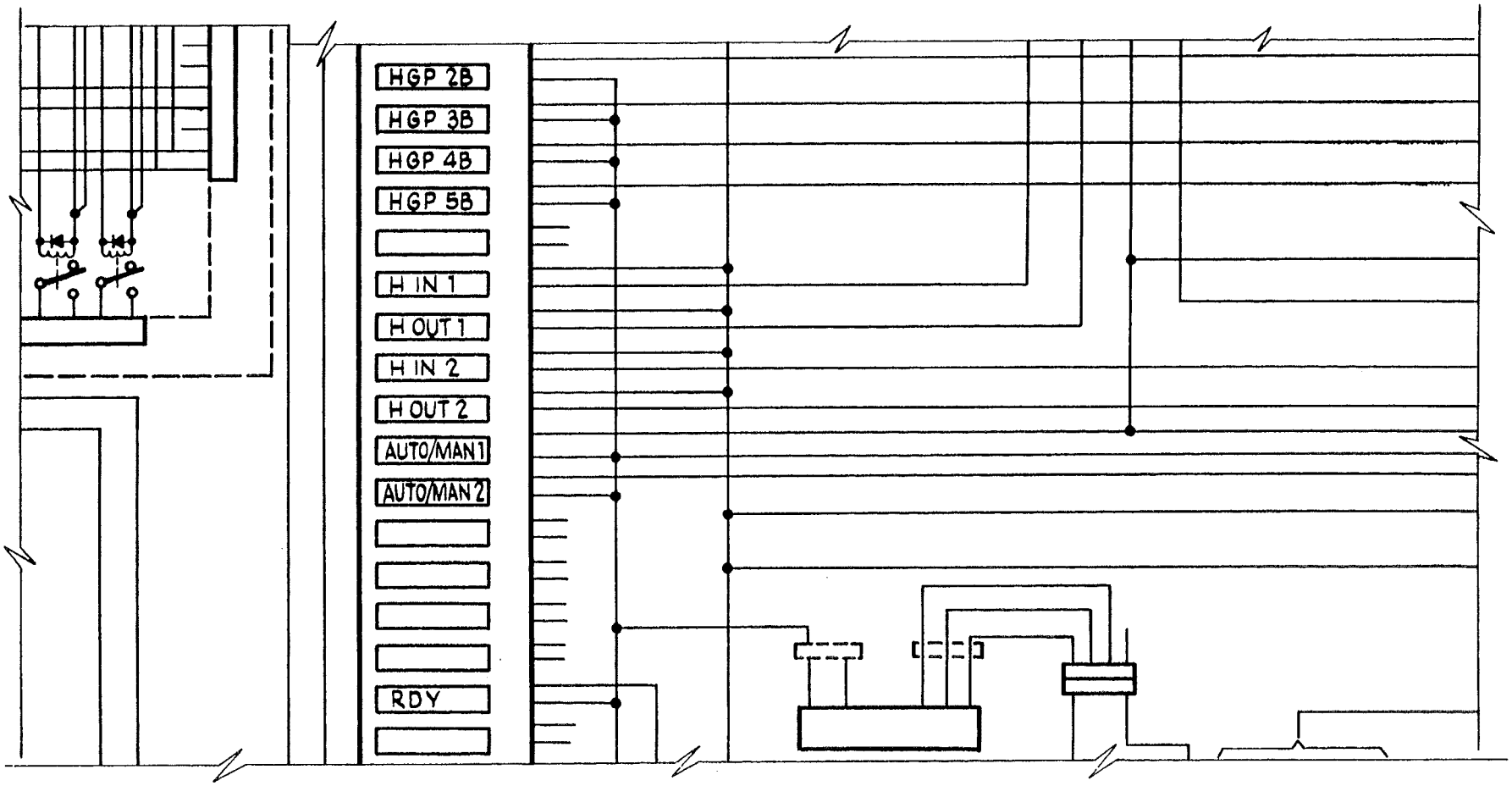
Figure 8F:
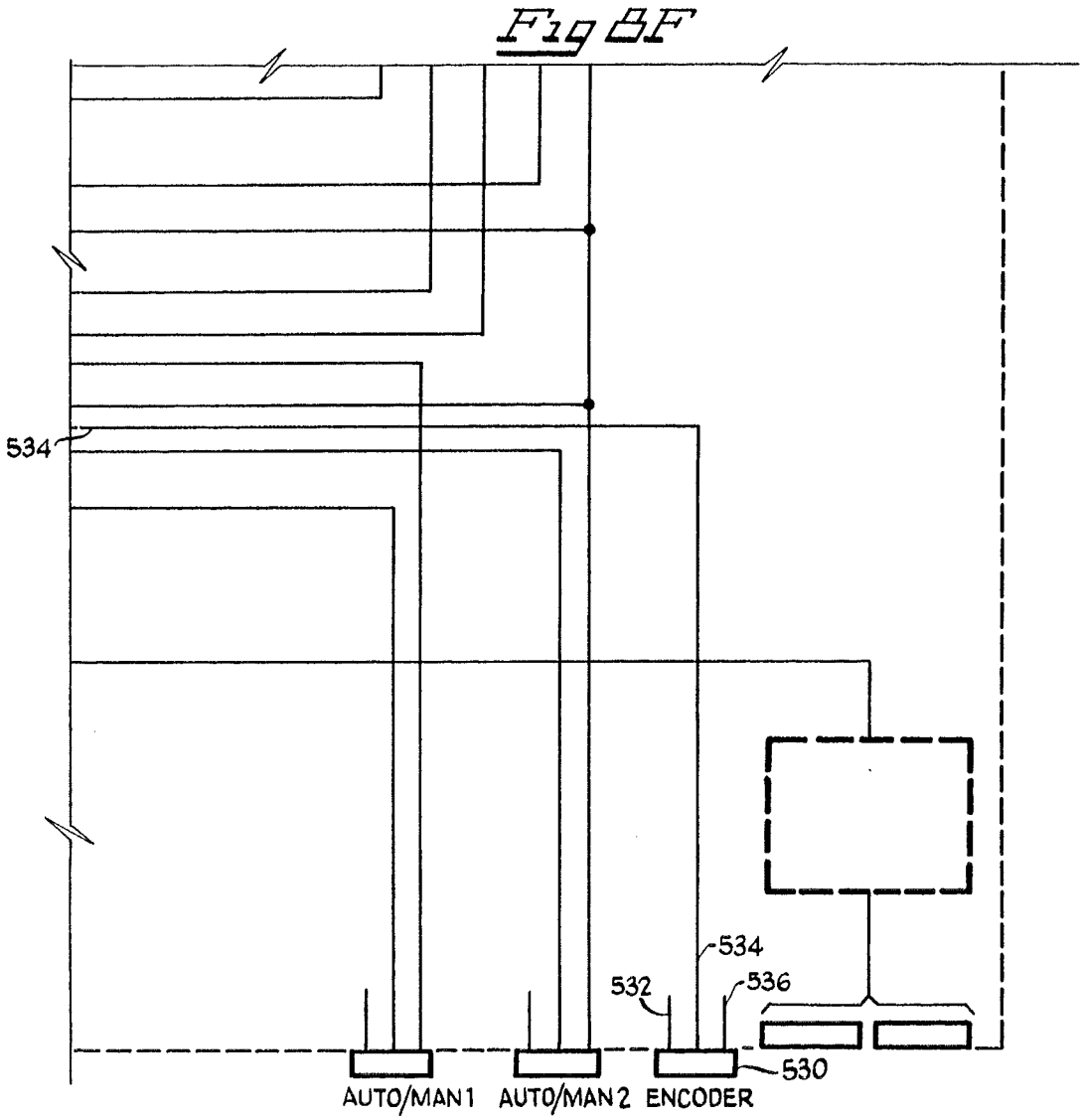
Figure 8G:
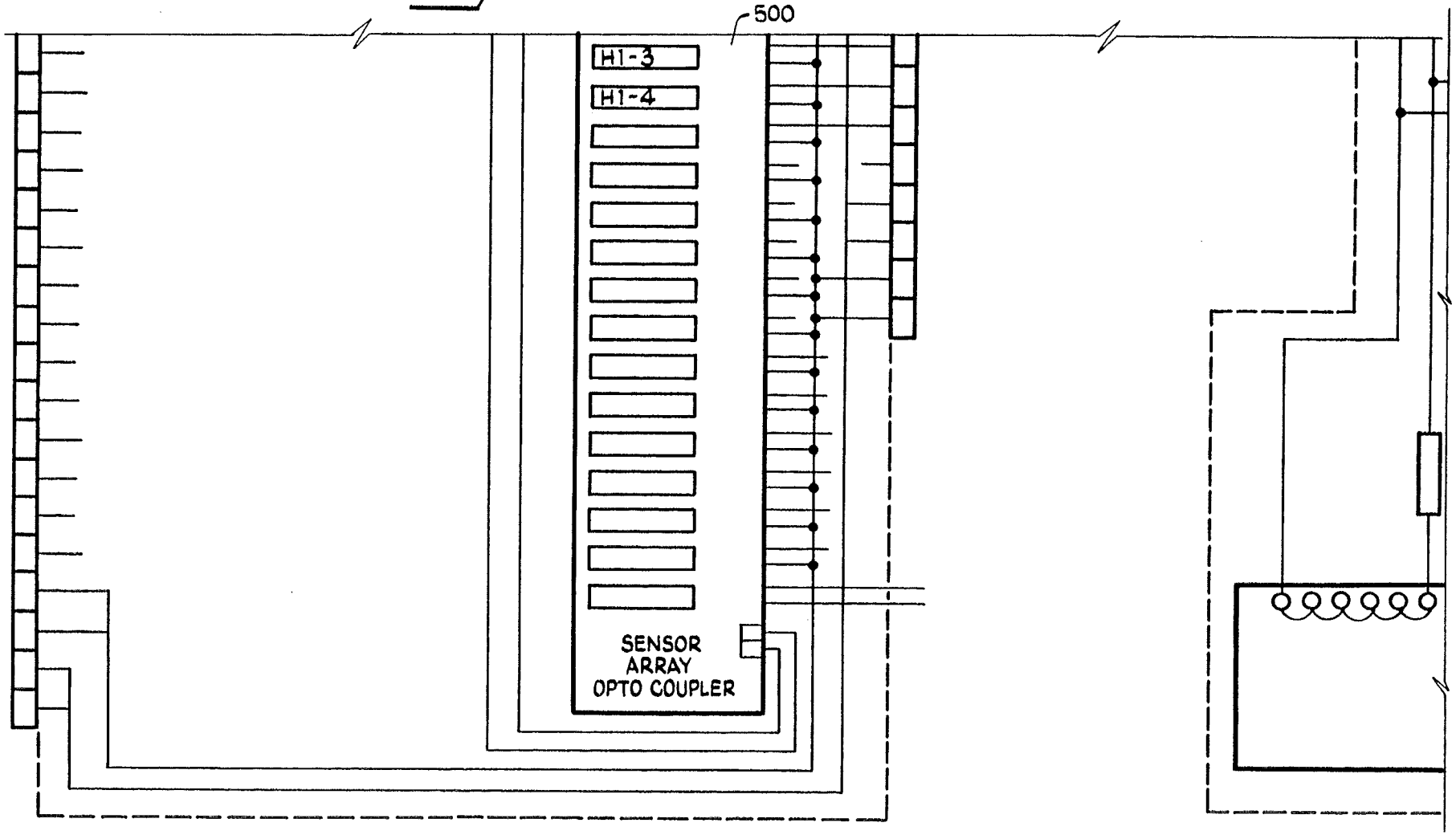
Figure 8H:
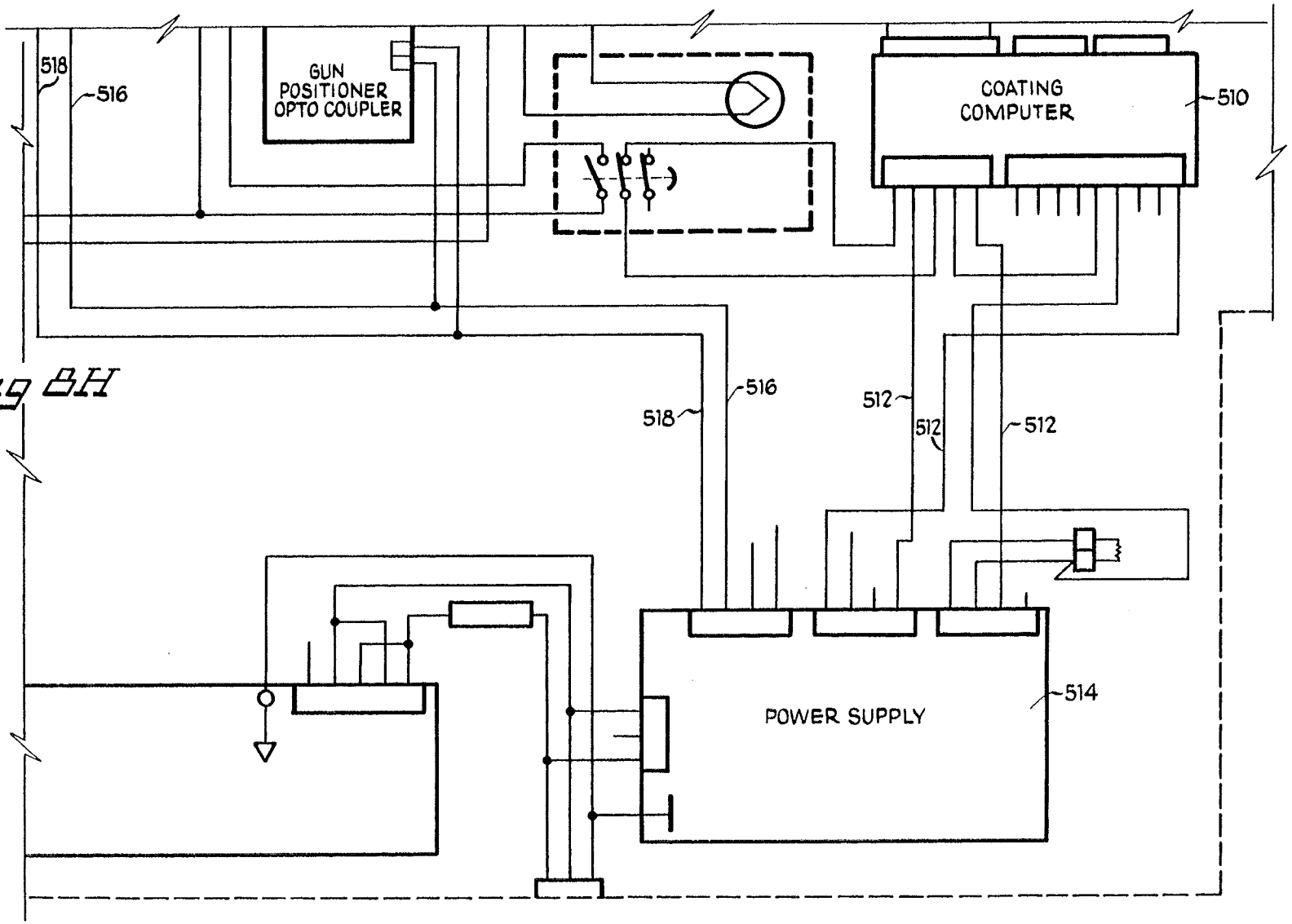

Referring now to FIGS. 8A through 8H, details of circuitry associated with the coating processor 80 are shown therein. The coating processor subsystem includes a gun array opto coupler 490 adapted to send signals to the plurality of spray guns to control their state and to send signals over a gun array coupler bus 492 via a plurality of relays 494 coupled to a bus connector 496 indicative of the operating state of the guns. As may best be seen in FIGS. 8D and 8G, a sensor array opto coupler 500 which is coupled to the optical sensor array provides output signals to other portions of the coating processor 80 so that the coating processor 80 can interpret when the retroreflective optical sensor array 18 is blocked, indicating that a workpiece is entering the inlet 14 of the spray booth. In addition, signals from the horizontal gun movers 130 and 132 shown in FIGS. 8B and 8C, are fed through a gun position optical coupler 504 to a coating processor which includes a coating computer 510. The computer 510 is energized over a plurality of leads 512 by a power supply 514. The power supply 514 also energizes the optical coupler over leads 516 and 518.

The system receives an optical shaft encoder signal from a shaft encoder associated with the workpiece conveyor at an encoder port 530 having a plurality of lines 532, 534 and 536. The encoder signal is fed to the coating computer where the pulses are counted to determine the relative position of the workpiece at any time.

Figure 7:
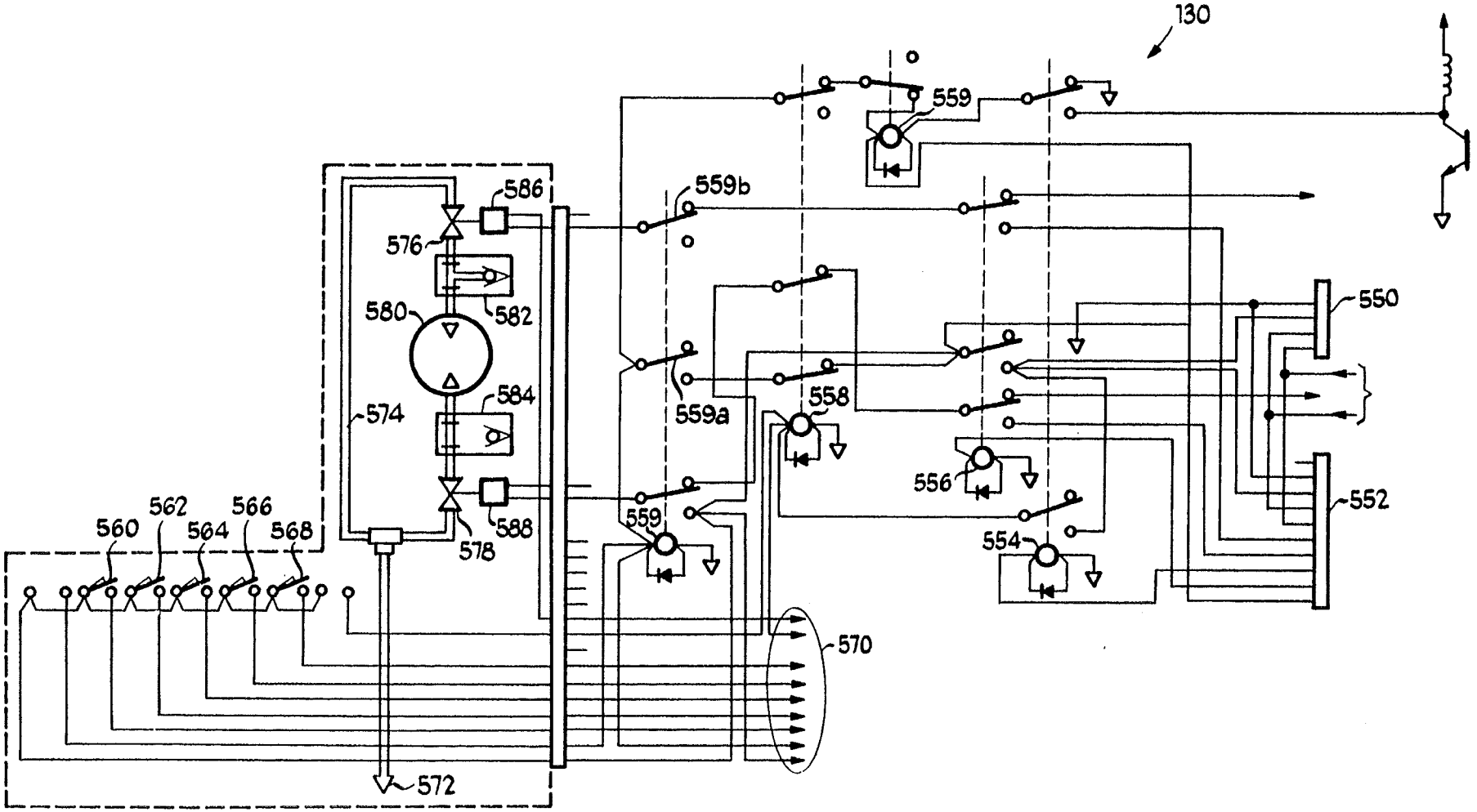
FIG. 7 is a schematic diagram of an exemplary gun mover circuit.

Referring now to FIG. 7, the gun mover 130 is shown therein and includes a pair of signal ports 550 and 552 which receive signals from the coding processor. The signals are fed to relays 554, 556, 558, 559, 559*a* and 559*b* which control the relative positioning of the gun array. The position of the gun array with respect to the spray booth is indicated by the closure of one of switches 560, 562, 564, 566 and 568 which provide switch signals on an output bus 570 connected to the coding processor. The relative position of the gun array may be changed by a pneumatic system 572 having a pneumatic line 574, a control valve 576, second control valve 578 and an air motor 580. The air motor is used to move the gun array with respect to the control valves. Also included are a pair of mufflers 582 and 584 connected to the air motor to reduce the noise from the operation of the motor. When the array is to be moved inwardly toward the workpiece, relay 558 closes. Relay 559 causes its switches 559*a* and 559*b* to assume one of two positions actuating either a valve operator 586 associated with valve 576 or 588 associated with valve 578 to run the motor in one of two directions.

Figure 9:
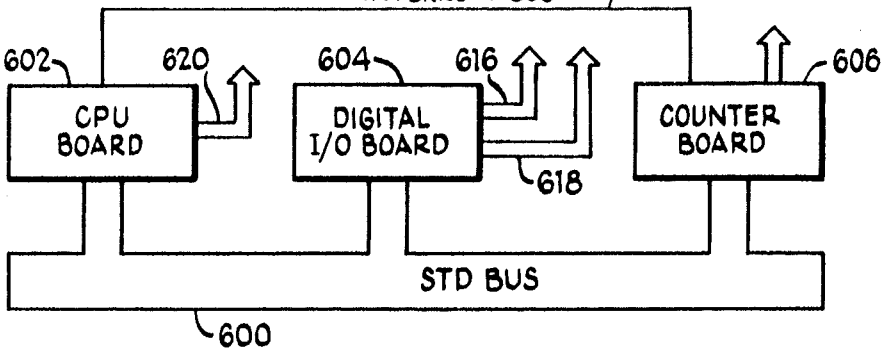
FIG. 9 is a schematic diagram of the coating computer.

Referring now to FIG. 9, the coating computer 510 is shown therein and comprises a standard or STD bus 600 having connected to it a Prolog Model 7871-01 central processing or CPU board 602, a Prolog Model 7508 digital I/O board 604 and a Prolog 73085-02 counter card 606. An interrupt bus 608 is connected between the counter card 606 and the CPU board 602 independent of the standard bus. A pair of opto 22 buses 616 and 618 connect the digital I/O board to the optical coupler 352 for the gun trigger board the optical coupler 350 for gun fault, respectively. A bus 620 connects the CPU board 602 to the pulse check opto coupler 266 which supplies signals to the CPU board representative of the pulsing signals delivered by the electronic timer 260 to the plurality of pulsating solenoid valve drivers 262, all as shown in FIGS. 6A through 6H.

Figure 10:
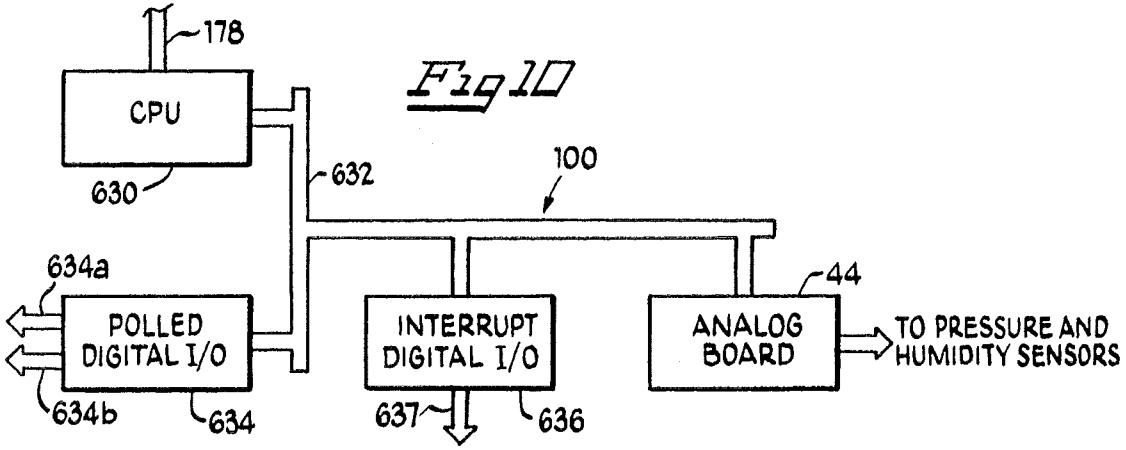
FIG. 10 is a schematic diagram of the diagnostic computer.
Figure 61:
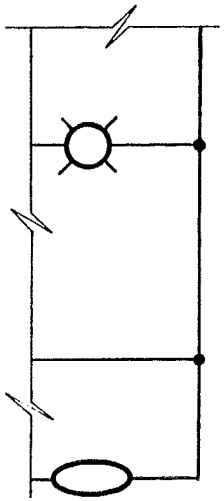

Referring now to FIG. 10 the diagnostic processor 100 is shown therein and includes a CPU board, a Prolog Model 7894-01, identified by reference numeral 630. An STD bus 632 is connected to the CPU board 630. The serial interface bus 178 which leads to the modem 176 is likewise connected to the CPU board 630. A polled digital I/O card 634, a Prolog Model 7508, is connected to the STD bus and includes a first bus 634*a* connected to the gun trigger optical coupler and a second bus 634*b* connected to the gun fault optical coupler. An interrupt digital I/O card 636, in this instance a Prolog Model 7515-01, is connected to the STD bus and has a bus 637 connected to the pulse check opto 22 optical coupler. The analog board 44 is also connected to the STD bus and receives, as was set forth previously, signals from the cartridge filter vacuum system, the final filter pressure system and the humidity sensor.

Figures 8F, 11:
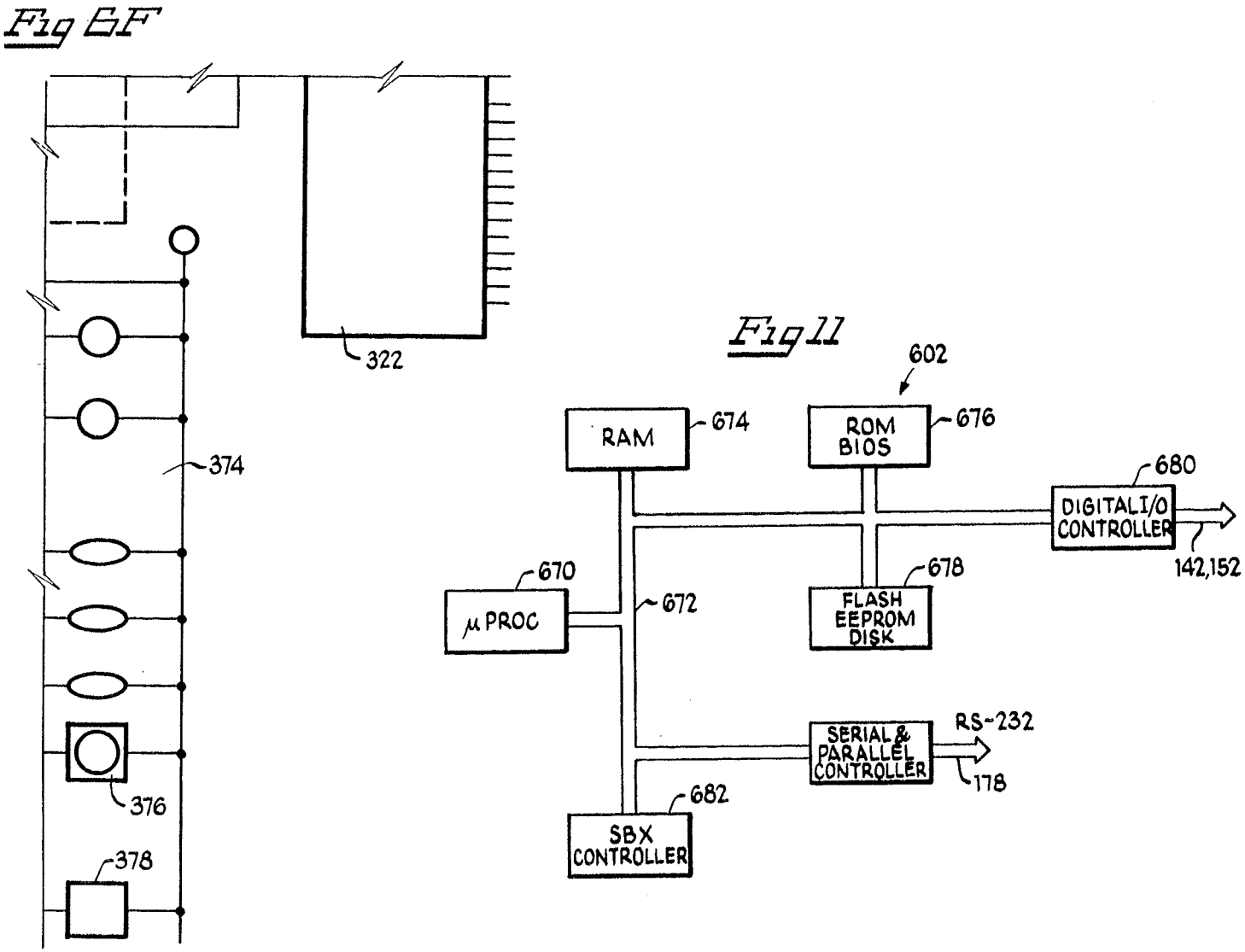
FIGS. 8A through 8H are schematic diagrams of the coating processor and operating stations.
FIG. 11 is a schematic diagram of the central processing unit of the coating computer.
Figure 6G:
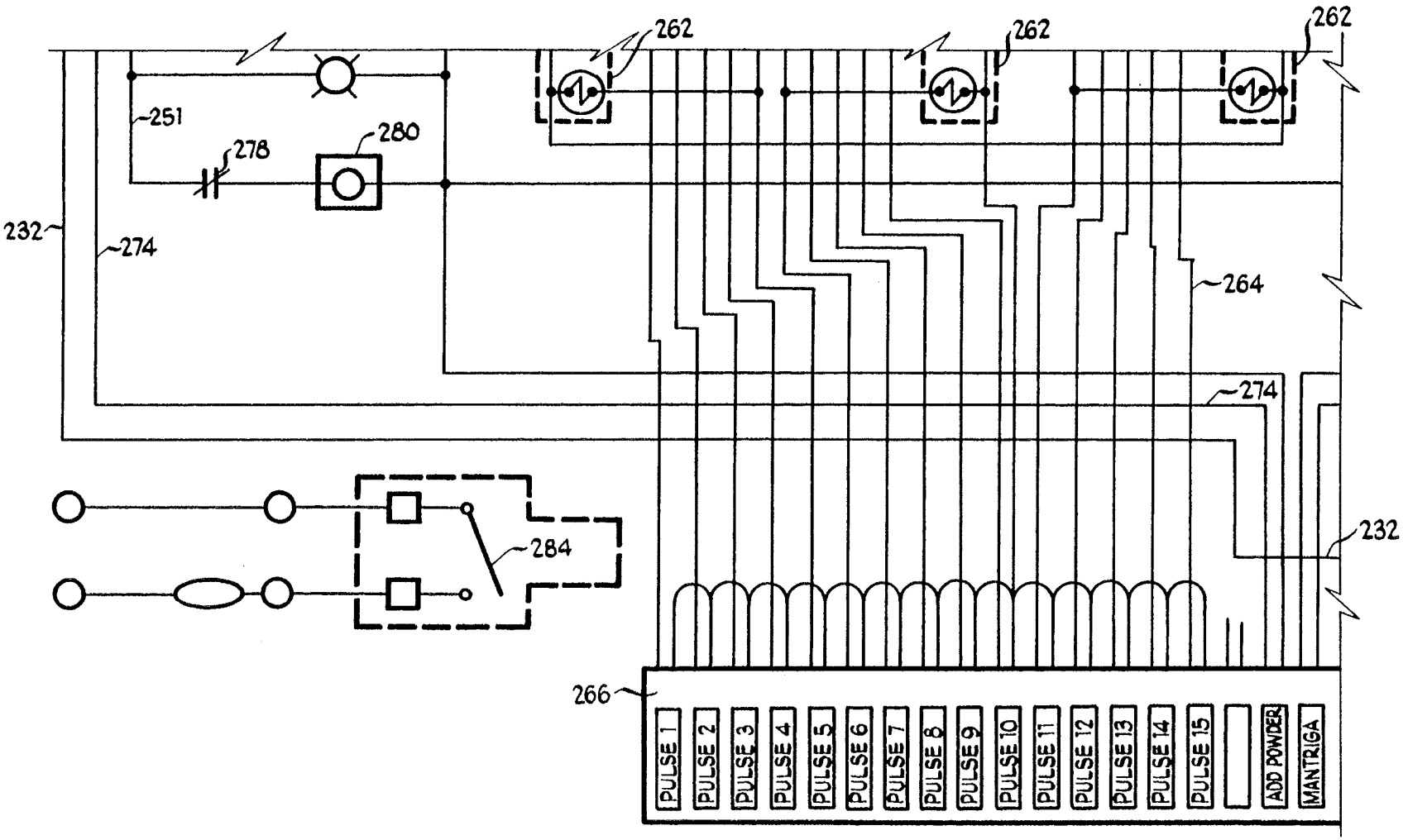
Figure 6H:
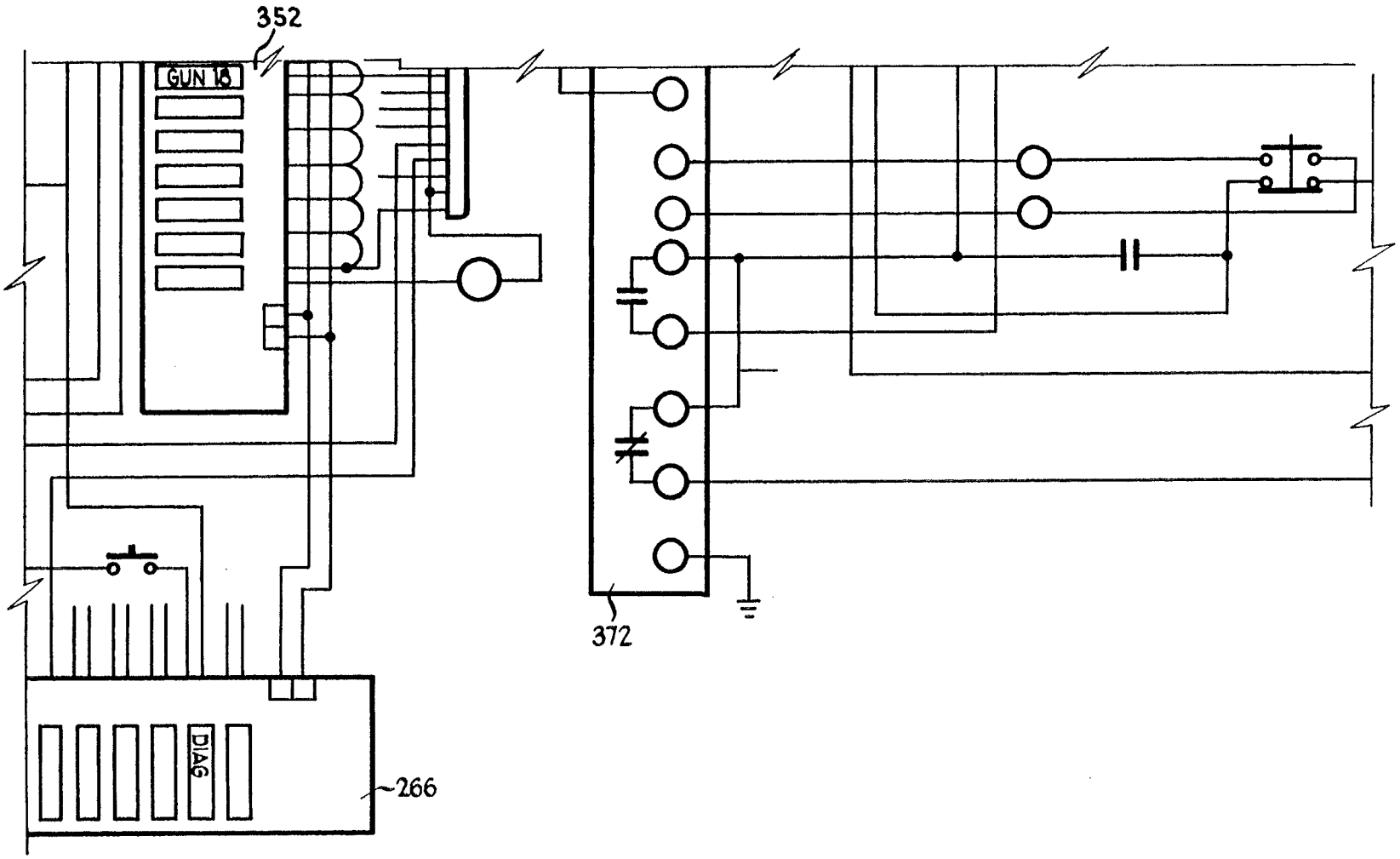

As may best be seen in FIG. 11, the CPU board 602 includes an 80C286 microprocessor 670 connected to a bus 672. A RAM 674 for holding data is connected to the bus 672 as is a ROM BIOS 676 which stores a basic input/output system which is DOS version 3.3 compatible. Flash EEPROM disc 678 and a digital I/O controller are both connected to the bus 672. The digital I/O controller communicates with the gun move circuitry. An SBX controller 682 is also connected to the bus, as is a serial and parallel communications controller 684 which communicates in RS-232 protocol and is connected to the line 178 which is coupled to the modem.

The layout of the CPU board for the coating processor is substantially similar, it also is an 80X86 compatible system, in this instance employing a Hitachi V20 microprocessor in combination with a disk operating system DOS version 3.3 and executing the program code.

The flash EEPROM disk 678 of the CPU board 602 holds the program code.

The remote computer 170 is an IBM-compatible personal computer operating under disc operating system or a personal computer operating system and executes the program code. All of the program code is written in C and has been compiled on the Borland Turbo C Compiler, version 2.0. Certain routines have been included in the code from the Quinn Curtis Company which are called by the code and are commercially available from Quinn Curtis.

Figure 3:
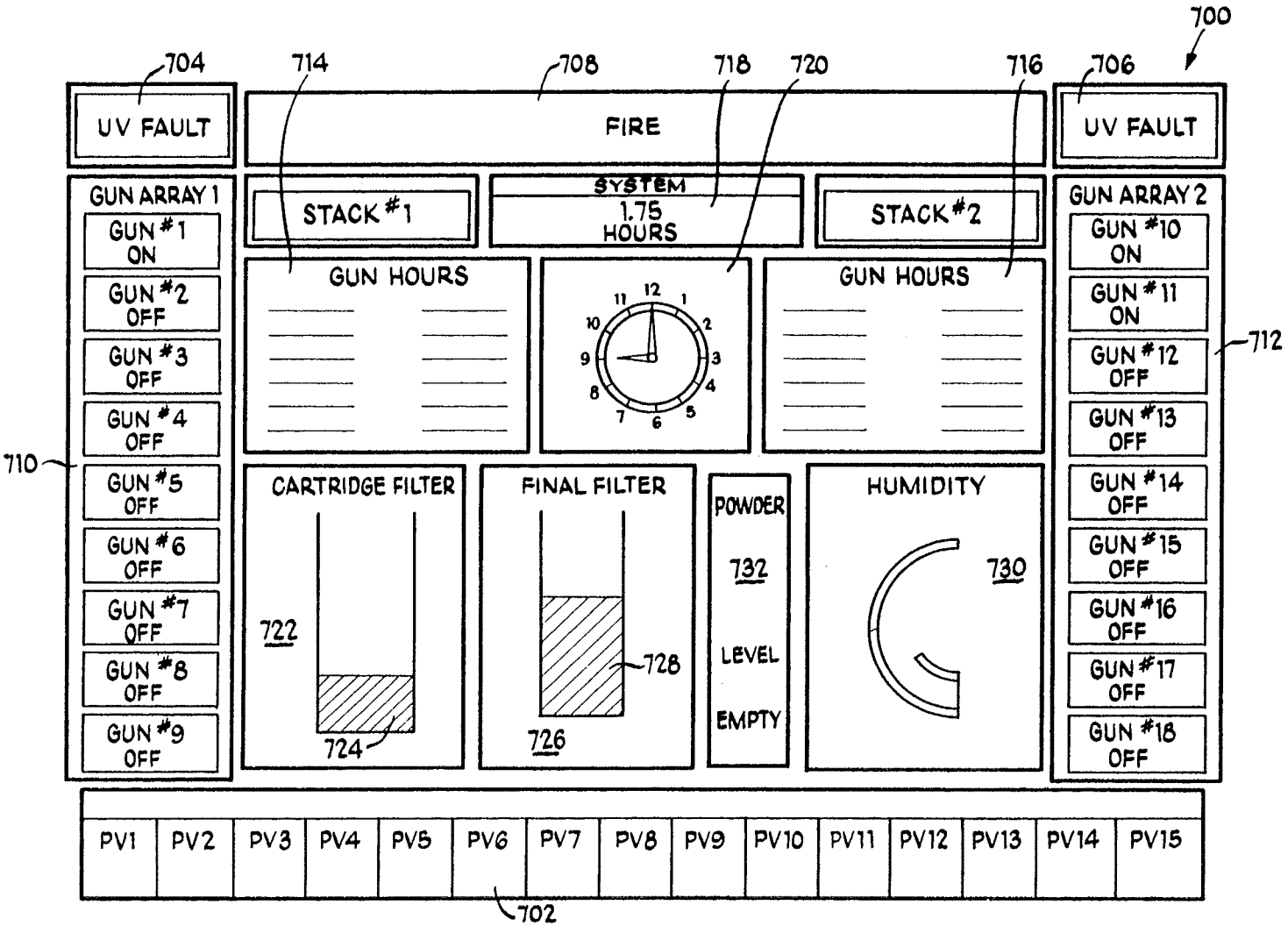
FIG. 3 is an elevational view of a screen display from a remote personal computer for the apparatus of FIG. 1.

Referring now to FIG. 3, the display on the personal computer is shown thereon. The display in general is referred to numeral 700 and includes a variety of display parameters. Across the bottom of the display are a plurality of blocks 702 labeled PV1 through PV15. The blocks 702 are indicative of whether a pulse signal has been sent to a particular pulse valve associated with a canister filter in the last 15 minutes. If the pulse signal has not been sent, the block color changes to red to indicate that there has been a failure to pulse the valves. A first UV fault indicator 704 and a second UV fault indicator 706 will be illuminated and an enunciator will be sounded in the event that UV light is detected in the chamber which would be indicative of an arcing condition. In the event there is a fire detection, the bar 708 is illuminated in red. In addition, the state of the guns in the gun arrays is also indicated in real time on the display. There is a first gun array display 710 and a second gun array display 712. Each of the gun array displays can display the states of nine guns indicating which of the guns are on, off and faulted. In addition, the number of hours the particular guns have been running, as well as the total number of hours from the last maintenance of the guns, is displayed in gun maintenance profile displays 714 and 716. The total time the system has been up and running is displayed in a system display 718. A clock 720 is provided for the convenience of the operator. A cartridge filter analog display 722 is provided to give the pressure head at the cartridge filter. The darkened portion of the column, generally indicated by numeral 724, rises and falls as the pressure changes. Likewise, a final filter pressure display 726 has a movable column 728 indicative of the display. A humidity display 730 provides an indication of the relative humidity of the inlet air going into the guns. A powder level display 732 provides an output indication when the powder chamber is empty or nearly empty. Thus, the remote computer allows the display of a variety of system parameters in real time which have not been previously available to the user of spray booths.

Figure 12:
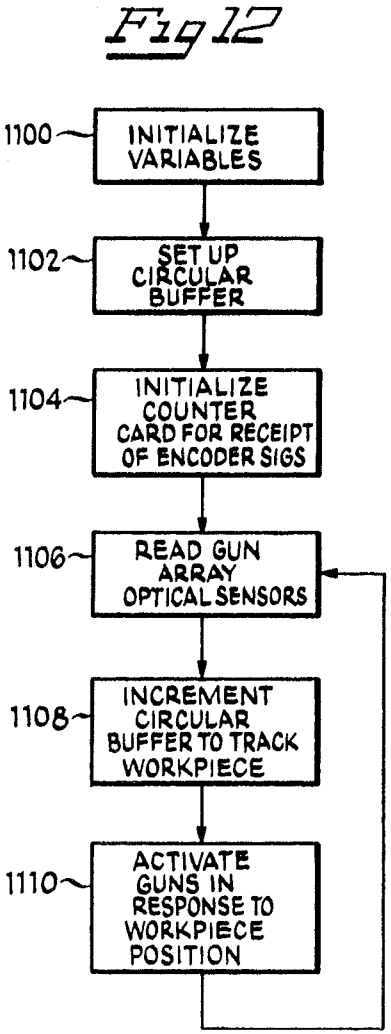
FIG. 12 is a high level flow diagram for the coating computer.

Referring now to FIG. 12, a flow chart shown therein of the general upper level flow of operating functions in the coating processor. The coating processor, when powered up, initializes its variables and sets up a circular buffer 1102 for holding information relating to objects passing the inlet which interrupt the beams of the optical array. The counter card 1104 which receives the encoder signals indicative of movement of objects along the spray booth is initialized for receipt of encoder signals. The gun array optical sensors are read 1106 and gun array information is stored in the circular buffer 1108. The circular buffer is then incremented under the influence of the counter signals in order to track any workpieces which may have interrupted the optical sensor. As a circular buffer's interrupt is incremented, a test is made of the contents of the buffer indicative of the point where the guns are located in a step 1110. The guns are then activated if there is a workpiece located in that position. They are not activated if the workpiece is not located there. The program then loops back to the step 1106 where the gun array is again being read. It may be appreciated that in this way the circular buffer provides an indication of the state of all workpieces as they move through interior of the spray booth without the necessity of actually having to send the workpieces within the relatively hostile environment of the spray booth where the electrostatic field and the paint powder is present.

Figure 13:
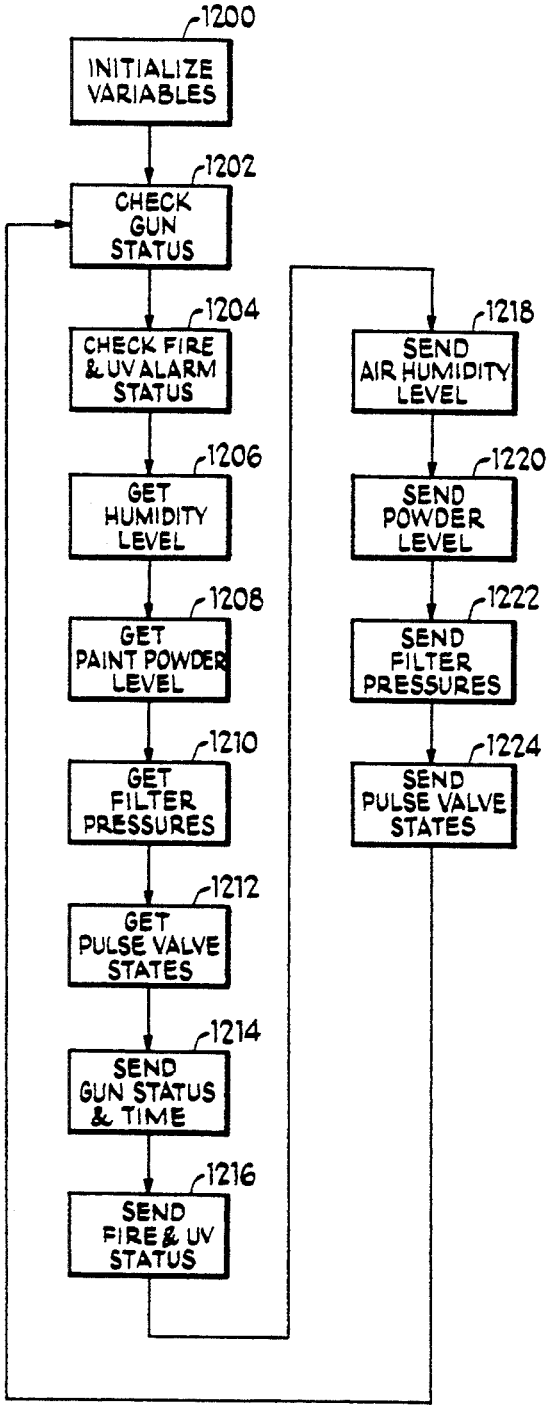
FIG. 13 is a high level flow diagram for the diagnostic computer.

Referring now to FIG. 13, the operation of the diagnostic computer is generally shown therein at a step 1200. The variables are initialized. Gun status is checked at a step 1202. Fire and UV alarm status is checked at a step 1204. The humidity level is obtained in a step 1206. Paint powder level is obtained in a step 1208. Filter pressures are obtained at a step 1210. Pulse valve states are obtained at a step 1212. Gun status and times are obtained at a step 1214. In the step 1216, the fire and UV status is sent over the modem. The air humidity level is sent in a step 1218 over the modem. The powder level is sent in a step 1220. The filter pressures are sent in a step 1222. The pulse valve state signals are sent in a step 1224 and control is returned to the gun status check step 1202.

Figure 14:
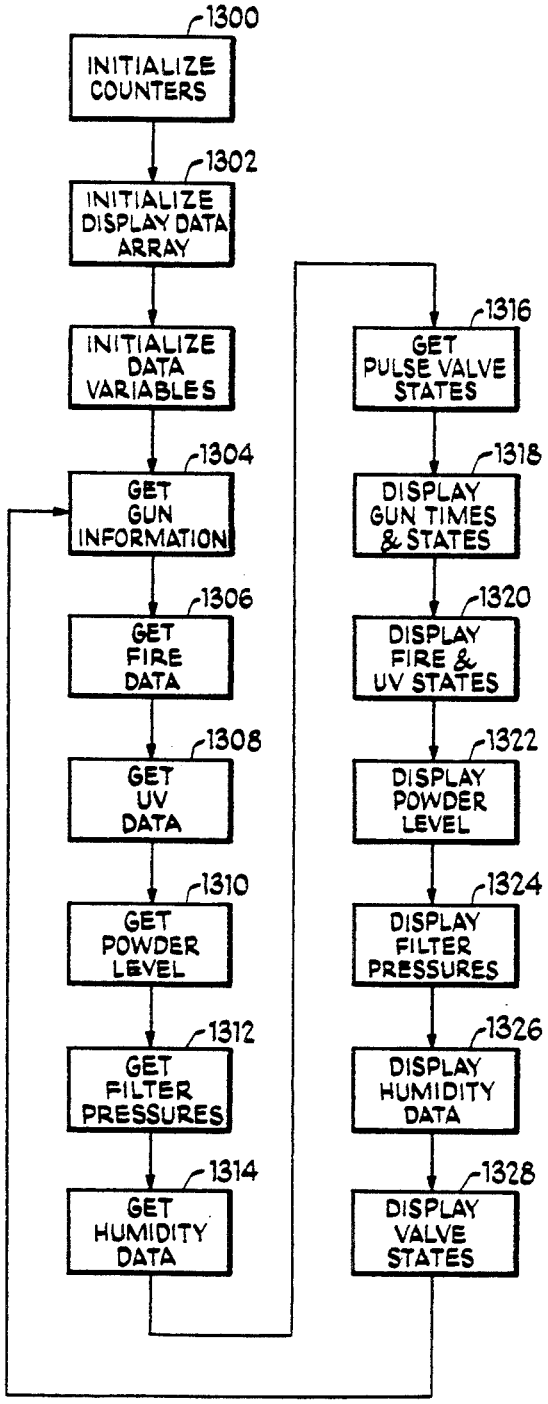
FIG. 14 is a high level flow diagram for the remote computer.

Referring now to FIG. 14, the remote monitor information flow is set forth therein. In a step 1300, the remote monitor initializes its counters, following that it initializes its display data arrays for holding the process variables which are to be transferred to it in step 1302. It then receives the gun state information in step 1304 which is to be displayed as the gun off/gun on signals as well as the elapsed time for which the guns have been used and the total elapsed time for which the guns have been used. Fire data is transferred in a step 1306, ultraviolet detector data transferred in a step 1308, powder level data transferred in a step 1310 and filter pressure data, both for the cartridge filter and the final filters in step 1312. Humidity data is transferred in step 1314 and the pulse valve signal state data is transferred in a step 1316. The gun times and states are displayed on the display of FIG. 3 and the step 1318 fire and UV states are displayed in step 1320. Powder level is displayed in a step 1322. The filter pressures are displayed in a step 1324. Humidity data is displayed in a step 1326 and the valve states are displayed in the step 1328, following which program flow returns to obtain additional gun information. It may be appreciated that the remote diagnostic monitor continually updates the information it receives to provide real time data as previously described herein.

It may be appreciated that while specific embodiments of the instant invention have been disclosed herein, the true spirit and scope of the instant invention shall be limited only by the appended claims.

What is claimed is:

1. Apparatus for electrostatic spray painting, comprising:

a painting chamber for receiving a workpiece to be spray painted;

a paint powder delivery system for storing and supplying paint powder;

a spray gun coupled to said paint powder delivery system, said spray gun being adapted to receive the paint powder from said paint powder delivery system and eject the paint powder into said painting chamber;

a high voltage electrostatic supply coupled to said spray gun for applying an electrical force to the paint powder to transport the paint powder toward the workpiece;

process condition responsive means for sensing a process condition characteristic and producing a process condition responsive signal;

a processor for executing a personal computer operating system and for receiving the process condition responsive signal from said process condition responsive means and generating a second process condition responsive signal;

a memory coupled to said processor for storing the personal computer operating system;

means connected to said processor for receiving said second process condition responsive signal and for providing an output indication responsive to the second process condition responsive signal; and communication means connected to said processor for remote transmission of a digital signal indicative of said second process condition responsive condition responsive signal.

2. Apparatus for electrostatic spray painting according to claim 1, wherein said process condition responsive means comprises a paint powder humidity system.

3. Apparatus for electrostatic spray painting according to claim 2, wherein said process condition responsive means comprises a painting chamber arc detector.

4. Apparatus for electrostatic spray painting according to claim 3, wherein said painting chamber arc detector comprises an ultraviolet detector.

5. Apparatus for electrostatic spray painting according to claim 4, wherein said process condition responsive means comprises a gun timer for outputting a signal indicative of the amount of time that a gun has been in operation for purposes of determining a preventive maintenance schedule.

6. Apparatus for electrostatic spray painting according to claim 5, wherein said process condition responsive means comprises means for determining when a backwashing air pressure signal is sent to a filter coupled to the paint powder chamber.

* * * * *